US009664044B2

(12) United States Patent
Lippitt et al.

(10) Patent No.: US 9,664,044 B2
(45) Date of Patent: May 30, 2017

(54) INVERTED V-8 I-C ENGINE AND METHOD OF OPERATING SAME IN A VEHICLE

(71) Applicants: Raymond F. Lippitt, Smithfield, NC (US); Kevin S. Sweeney, Fairview Heights, IL (US)

(72) Inventors: Raymond F. Lippitt, Smithfield, NC (US); Kevin S. Sweeney, Fairview Heights, IL (US)

( * ) Notice: Subject to any disclaimer, the term of this patent is extended or adjusted under 35 U.S.C. 154(b) by 315 days.

(21) Appl. No.: 14/579,229

(22) Filed: Dec. 22, 2014

(65) Prior Publication Data

US 2015/0136083 A1 May 21, 2015

Related U.S. Application Data

(63) Continuation-in-part of application No. PCT/US2013/070387, filed on Nov. 15, 2013.

(51) Int. Cl.
*F01B 1/10* (2006.01)
*F02D 41/00* (2006.01)
(Continued)

(52) U.S. Cl.
CPC ..... *F01B 1/10* (2013.01); *F02B 75/225* (2013.01); *F02D 41/0087* (2013.01);
(Continued)

(58) Field of Classification Search
CPC ..... F02B 75/021; F02B 75/225; F02D 41/30; F02D 41/12; F02D 41/0087; F01B 1/10
See application file for complete search history.

(56) References Cited

U.S. PATENT DOCUMENTS 1,468,819 A 9/1923 Knudsen
1,681,910 A 8/1928 Slaght
(Continued)

FOREIGN PATENT DOCUMENTS

DE 31 32 502 3/1983
GB 301677 12/1928

OTHER PUBLICATIONS

International Search Report and Written Opinion dated Aug. 18, 2015 for Appln. No. PCT/US2015/033561.
(Continued)

*Primary Examiner* — Jacob Amick
(74) *Attorney, Agent, or Firm* — Pillsbury Winthrop Shaw Pittman, LLP

(57) ABSTRACT

In an inverted V-8 engine capable of operating in power level steps with four pairs of piston and cylinder assemblies having fuel injectors with dual options, the improvement which comprises a three component frame structure having cooperating interengaging surfaces containing two banks of four inline crankshaft connected piston and cylinder units converging angularly upwardly from two interconnected crankshafts. The surface-to-surface contact between the block component and head component includes oppositely paired cylinder open ends covered by cam operated valving in the head component with the adjacent upper combustion chambers of each pair of cylinders being communicated by an intercommunicating polished passage formed in a two-piece insert fixedly positioned in a recess in the head component and a method of operating the engine in a vehicle.

20 Claims, 17 Drawing Sheets

(51) Int. Cl.

| | |
|---|---|
| ***F02D 41/12*** | (2006.01) |
| ***F02B 75/22*** | (2006.01) |
| *F02D 41/38* | (2006.01) |
| *F02B 75/06* | (2006.01) |
| *F02B 75/18* | (2006.01) |

(52) U.S. Cl.
CPC ..... *F02D 41/12* (2013.01); *F02B 75/065* (2013.01); *F02B 75/228* (2013.01); *F02B 2075/1832* (2013.01); *F02D 2041/389* (2013.01)

(56) References Cited

U.S. PATENT DOCUMENTS

| | | | | |
|---|---|---|---|---|
| 2,137,941 | A | 11/1938 | Helmore et al. | |
| 2,269,948 | A | 1/1942 | Mallory | |
| 2,439,073 | A | 4/1948 | Butterfield | |
| 2,468,976 | A | 5/1949 | Herreshoff et al. | |
| 3,472,212 | A | 10/1969 | Chamberlain | |
| 3,623,463 | A | 11/1971 | De Vries | |
| 3,880,126 | A | 4/1975 | Thurston et al. | |
| 4,170,970 | A | 10/1979 | McCandless | |
| 4,172,434 | A | 10/1979 | Coles | |
| 4,250,850 | A | 2/1981 | Ruyer | |
| 4,955,328 | A * | 9/1990 | Sobotowski | F02B 25/12 123/51 R |
| 5,022,353 | A | 6/1991 | Kamamura | |
| 5,555,871 | A | 9/1996 | Gopp et al. | |
| 6,209,495 | B1 | 4/2001 | Warren | |
| 6,334,435 | B1 | 1/2002 | Negre et al. | |
| 6,338,328 | B1 | 1/2002 | Mower et al. | |
| 6,363,907 | B1 | 4/2002 | Arai et al. | |
| 6,978,204 | B2 | 12/2005 | Surnilla et al. | |
| 6,988,471 | B2 | 1/2006 | Chang | |
| 6,994,057 | B2 | 2/2006 | Loth et al. | |
| 7,080,615 | B2 | 7/2006 | Shinogle | |
| 7,219,634 | B2 | 5/2007 | Hitomi et al. | |
| 7,383,797 | B2 | 6/2008 | Tour | |
| 7,578,267 | B2 | 8/2009 | Hofbauer et al. | |
| 7,584,724 | B2 | 9/2009 | Berger | |
| 7,597,084 | B2 | 10/2009 | Vachon et al. | |
| 7,685,988 | B2 | 3/2010 | Almkvist et al. | |
| 7,823,547 | B2 | 11/2010 | Forner, Sr. et al. | |
| 7,954,472 | B1 | 6/2011 | Sturman | |
| 7,958,864 | B2 | 6/2011 | Sturman | |
| 8,006,656 | B2 | 8/2011 | Branyon et al. | |
| 8,051,811 | B2 | 11/2011 | Phillips | |
| 8,132,546 | B2 | 3/2012 | Surnilla | |
| 8,156,904 | B2 | 4/2012 | Giannini et al. | |
| 8,443,769 | B1 * | 5/2013 | Lippitt | F02B 25/04 123/568.13 |
| 8,899,193 | B2 | 12/2014 | Lippitt et al. | |
| 9,026,339 | B1 | 5/2015 | Sturman | |
| 2002/0033167 | A1 | 3/2002 | Hiraku et al. | |
| 2005/0022755 | A1 | 2/2005 | Hitomi | |
| 2005/0109302 | A1 | 5/2005 | Tetsuno et al. | |
| 2006/0102124 | A1 | 5/2006 | Calderwood | |
| 2006/0278181 | A1 | 12/2006 | Park | |
| 2008/0029057 | A1 | 2/2008 | Hergart et al. | |
| 2009/0020103 | A1 | 1/2009 | Van Avermaete | |
| 2009/0145396 | A1 | 6/2009 | Almkvist et al. | |
| 2009/0183699 | A1 | 7/2009 | Sturman | |
| 2010/0050978 | A1 | 3/2010 | Hofbauer | |
| 2010/0056327 | A1 | 3/2010 | Hofbauer | |
| 2010/0229806 | A1 | 9/2010 | Kemeny | |
| 2010/0229836 | A1 | 9/2010 | Hofbauer et al. | |
| 2010/0284824 | A1 | 11/2010 | Hippen et al. | |
| 2010/0308685 | A1 | 12/2010 | Hippen et al. | |
| 2010/0326394 | A1 | 12/2010 | Hofbauer | |
| 2011/0022289 | A1 | 1/2011 | Hofbauer | |
| 2011/0057049 | A1 | 3/2011 | Hofbauer et al. | |
| 2011/0215575 | A1 | 9/2011 | Hofbauer et al. | |
| 2011/0220080 | A1 | 9/2011 | Meldolesi et al. | |
| 2011/0241473 | A1 | 10/2011 | Hippen et al. | |
| 2011/0251773 | A1 | 10/2011 | Sahandiesfanjani et al. | |
| 2011/0290207 | A1 | 12/2011 | Kaufman et al. | |
| 2012/0073538 | A1 | 3/2012 | Hofbauer | |
| 2012/0085302 | A1 | 4/2012 | Cleeves | |
| 2012/0085305 | A1 | 4/2012 | Cleeves et al. | |
| 2012/0103314 | A1 | 5/2012 | Jackson et al. | |
| 2015/0136069 | A1 | 5/2015 | Lippitt | |
| 2015/0136083 | A1 | 5/2015 | Lippitt | |
| 2015/0142291 | A1 | 5/2015 | Lippitt et al. | |
| 2015/0167548 | A1 | 6/2015 | Lippitt | |

OTHER PUBLICATIONS

International Preliminary Report on Patentability dated Sep. 15, 2016 for Appln. No. PCT/US2013/070387.
U.S. Notice of Allowance dated Aug. 17, 2015 for U.S. Appl. No. 14/291,636.
Written Opinion dated May 24, 2016 for Appln. No. PCT/US2015/033561.
International Preliminary Report on Patentability dated Aug. 17, 2016 for Appln. No. PCT/US2015/033561.
Split Cycle Engine, obtained from url: <http://en.wikipedia.org/wiki/Split_cycle_engine> on Apr. 26, 2012.
Scuderi Engine, obtained from url: <http://en.wikipedia.org/wiki/Scuderi_Engine> on Apr. 26, 2012.
EcoMotors International Technology, obtained from url: <http://www.ecomotors.com/technology> on May 10, 2012.
International Search Report and Written Opinion for PCT/US2013/070387 dated Apr. 21, 2014.
Extended European Search Report dated Jan. 3, 2017 for Appln. No. 13878390.7.

* cited by examiner

| CR | PAIR 1 | | | | PAIR 2 | | | | PAIR 3 | | | | PAIR 4 | | | |
|---|---|---|---|---|---|---|---|---|---|---|---|---|---|---|---|---|
| | BKL | | BKR | | BKL | | BKR | | BKL | | BKR | | BKL | | BKR | |
| | CE | PM | CE | PM | CE | PM | CE | PM | CE | PM | CE | PM | CE | PM | CE | PM |
| 0° | F | D | F | D | E | U | E | U | C | U | C | U | I | D | I | D |
| 180° | E | U | E | U | I | D | I | D | F | D | F | D | C | U | C | U |
| 360° | I | D | I | D | C | U | C | U | E | U | E | U | F | D | F | D |
| 540° | C | U | C | U | F | D | F | D | I | D | I | D | E | U | E | U |
| 720° | | | | | | | | | | | | | | | | |

| | PAIR 1 | | | | PAIR 2 | | | | PAIR 3 | | | | PAIR 4 | | | |
|---|---|---|---|---|---|---|---|---|---|---|---|---|---|---|---|---|
| | BKL | | BKR | | BKL | | BKR | | BKL | | BKR | | BKL | | BKR | |
| CR | CE | PM | CE | PM | CE | PM | CE | PM | CE | PM | CE | PM | CE | PM | CE | PM |
| 0° | F | D | F | D | E | U | E | U | C | U | C | U | I | D | I | D |
| 180° | E | U | E | U | I | D | I | D | F | D | F | D | C | U | C | U |
| 360° | I | D | I | D | C | U | C | U | E | U | E | U | F | D | F | D |
| 540° | C | U | C | U | F | D | F | D | I | D | I | D | E | U | E | U |
| 720° | | | | | | | | | | | | | | | | |

INVERTED V-8 I-C ENGINE AND METHOD OF OPERATING SAME IN A VEHICLE

CROSS-REFERENCE APPLICATIONS

The present application is a continuation-in-part of International Patent Application No. PCT/US2013/070387 bearing an international filing date of Nov. 15, 2013 which was published on Sep. 18, 2014 as No. WO 2014/143211, the entirety of which is incorporated herein by reference.

FIELD OF INVENTION

This invention relates to internal combustion engines and more particularly to engines having fuel saving operating modes of the type disclosed in U.S. Pat. No. 8,443,769, the entire disclosure of which is hereby incorporated herein by reference.

BACKGROUND OF THE INVENTION

The fuel saving modes of the '769 patent involve a step forward in the evolution of "skipping" technology. A skipped piston and cylinder is one that does not receive an injection of fuel during the injection stroke in which fuel would normally be injected. For the first time, the piston of the skipped piston and cylinder assembly actually enters into the creation of power rather than simply being neutral or requiring power from the rest of the engine to be moved through repeated cycles without cycle events taking place. The skipped piston enters into the creation of power by means of a passage between the combustion chambers of two paired assemblies. The increased pressure conditions in the cylinder of its paired assembly resulting from the internally fired power drive stroke therein is communicated by the passage to the skipped piston, causing it to undergo a simultaneous shared power drive stroke. Since the skipped piston is directly connected to the crankshaft, its shared power drive stroke creates power in the engine.

The '769 patent discloses several different engine configurations embodying the skipping advance including an opposed piston eight cylinder engine.

In the opposed piston eight cylinder engine disclosed in the '769 patent, two banks of four inline piston and cylinder assemblies each moving like a four cylinder engine. The two banks are configured in opposed inline relation to one another rather than in the more convenient V configuration. In each bank of four inline piston and cylinder assemblies, the side-by-side middle two which move together have their combustion chambers close enough to provide the passage necessary to achieve the shared power advancement during skipping. Consequently, there are two pairs out of a possible four which can operate on the advanced skipping/shared power.

The present invention has for one non-limiting object to provide an eight cylinder engine configuration which is in a convenient V configuration and provides the maximum four pairs of side-by-side piston and cylinder assemblies that can operate in accordance with the skipping principles of the '769 patent.

BRIEF DESCRIPTION OF THE INVENTION

In accordance with the principles of the present invention, this object is obtained by mounting the eight piston and cylinder assemblies in two banks of four inline assemblies in a V formation. However, the V formation is inverted in comparison with the conventional V-8. Instead of having one crankshaft driving the pistons of both banks as in a conventional V-8, the inverted V configuration provides two spaced drive interconnected crankshafts, one driving the pistons of each bank. The inverting of the V configuration brings the upper combustion chamber ends of each bank of cylinders into a side-by-side relation providing four pairs of simultaneously moved side-by-side assemblies that can and do have passages intercommunicating the side-by-side combustion chambers thereof, thereby enabling all four pairs to operate on the skipping principles of the '769 patent.

Another non-limiting object of the present invention is to provide a commercially acceptable inverted V-8 engine construction which is cost effective.

The invention is also concerned with an improved preferred embodiment of an inverted V-8 internal combustion (I-C) engine having a construction which is cost effective. The improved I-C engine comprises eight inline cylinders mounted in two banks of four cylinders converging angularly and upwardly in a block component of the frame assembly so that open upper ends of the cylinders are disposed within upwardly facing surfaces of the block component in four interrelated pairs. Each pair is spaced transversely with respect to one another, covering the open upper ends of the cylinders with valved portions of a head component of the frame assembly supported on the block component and having downwardly facing surfaces in sealing relation with respect to the upwardly facing surfaces of the block component. This forms four recesses in communicating relation with the surface means of one of the head and block components at positions between the four interrelated pairs of cylinder open ends, fixedly mounting an insert of heat-resistant material in each recess having a passage extending therethrough with spaced open ends thereof communicating with an associated pair of spaced cylinder open ends respectively.

The invention also includes a method of operating the engine to move a vehicle in which the engine is mounted in driving relation so that the speed of vehicle movement is responsive to the movement of accelerator pedal from an initial position to a maximum position. The method includes computer controlling the injectors of each of the four pairs of assemblies as the pedal moves through five progressively more powerful zones causing a progression of five steps to take place within the four pairs of assemblies, starting with all four pairs undergoing paired shared power drive strokes, and changing one pair to undergo a paired directly fired power drive stroke in each progressive step so that at the high zone all four pairs have paired directly fired power drive strokes. The method also includes computer controlling the injectors so as to vary the increase of the amount of fuel injected from the beginning of each zone to the end of the next zone so that the total amount of fuel injected at the end of each zone is equal to the total amount of fuel injected in the greater number of injections in the next zone.

Other objects, features, and advantages of the present invention will become apparent from the following detailed description, the accompanying drawings, and the appended claims.

DETAILED DESCRIPTION OF THE ILLUSTRATED EMBODIMENTS

Figure 1:
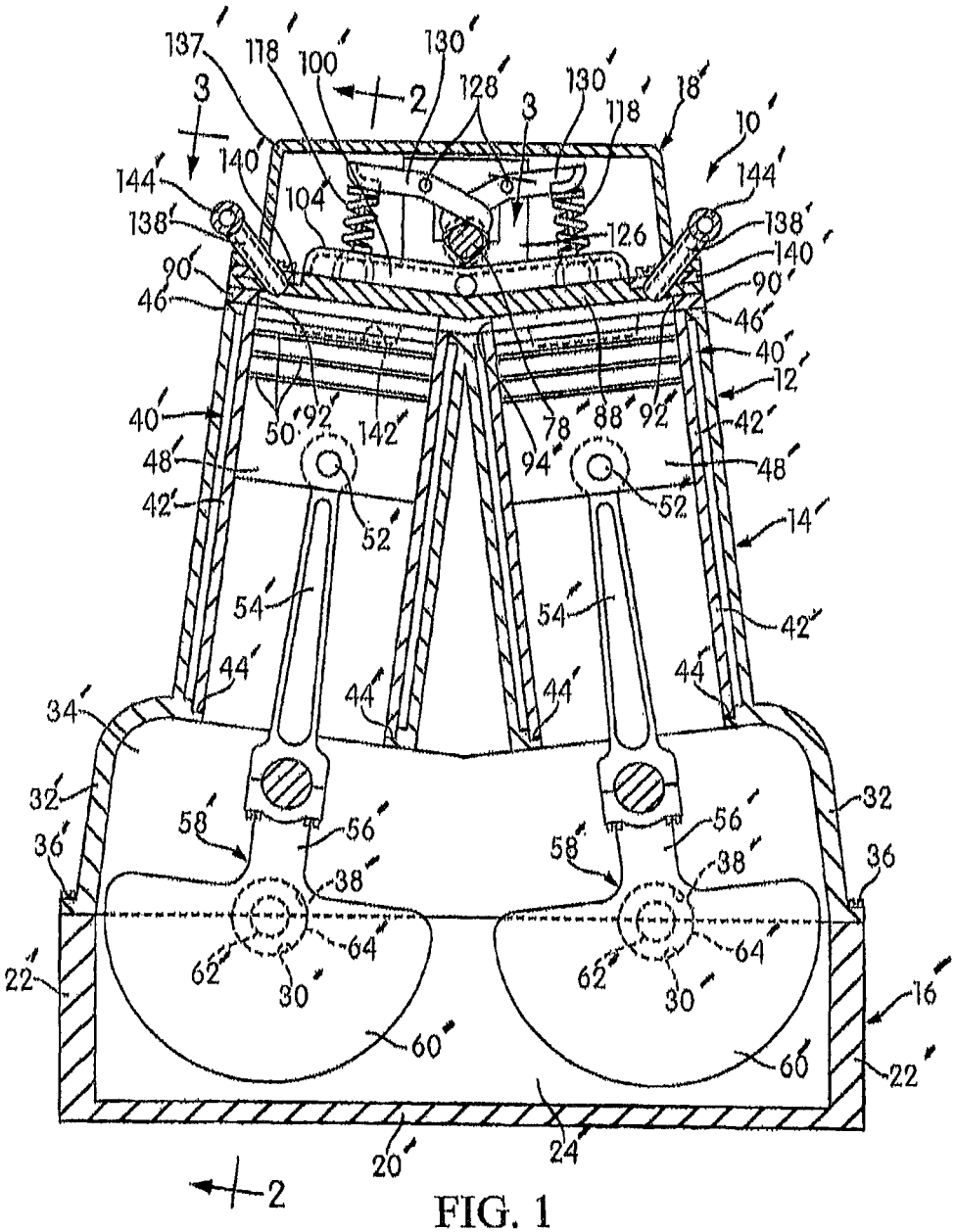
FIG. 1 is a sectional view through the center lines of two piston and cylinder assemblies of the two banks of four in an inverted V-8 engine embodying the principles of the present invention.
Figure 2:
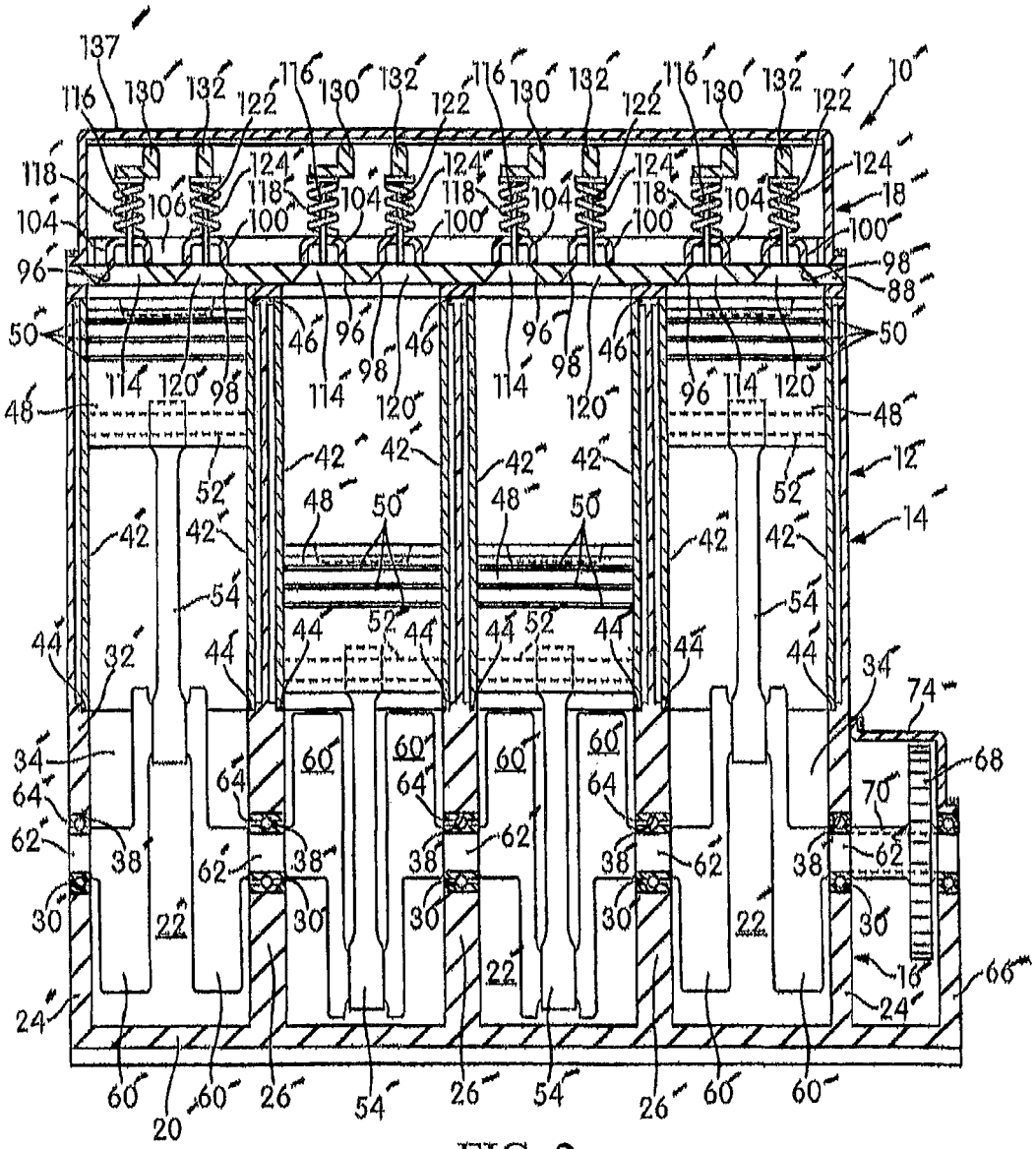
FIG. 2 is a sectional view taken along the line 2-2 of FIG. 1.

FIGS. 1-8 show one embodiment of an inverted V-8 cylinder internal combustion engine, generally indicated at 10', which embodies the principles of the present invention. The engine 10' includes a frame structure, generally indicated at 12', which includes a main block section 14', a lower pan section 16' and an upper head assembly 18'. The lower pan section 16' serves as a support for the main black section 14'. As shown in FIGS. 1 and 2, the pan 16' includes a bottom wall 20' having spaced side walls 22' extending upwardly therefrom and spaced end walls 24' extending upwardly from the bottom wall 20' between the ends of the side walls 22'. As best shown in FIG. 2, extending between the side walls 22', inwardly of the end walls 24' are four equally spaced parallel inner walls 26'.

The end walls 24' and parallel inner walls 26' of the lower pan section 16' have upwardly facing planar surfaces interrupted by longitudinally aligned spaced pairs of upwardly facing 180° arcuate bearing engaging surfaces 30'.

The main block section 14' includes a lower portion defined by exteriorly flanged upwardly and inwardly sloping side walls 32' vertically aligned with the side walls 22', upright end walls 34' vertically aligned with the end walls 24' of the lower pan section 16' and four interior walls 36' vertically aligned with the four inner walls 26' of the lower pan sections. The vertically aligned walls 32', 34' and 36' of the block section 14' have downwardly facing surfaces which engage the upwardly facing wall surface of pan section 16'. Suitable fasteners 38' extending through the flanges of the exteriorly flanged upright walls 32' of the lower portion of the block section 14' and into the aligned side walls 24' of the lower pan section 16' serve to fixedly the block section 14' on the lower pan section 16'.

The lower portion of the main block section 14' does not have downwardly facing surfaces which engage the 180° arcuate surfaces 30' of the lower pan section 16'; instead the lower portion of the block section 14' has downwardly facing 180° arcuate bearing engaging surfaces 38' in alignment with the arcuate surfaces 30' of the lower pan section 16'.

The main block section 14' also includes a main upper portion configured to receive therein two banks of piston and cylinder assemblies, generally indicated at 40' which diverge downwardly from the top of the block section 14'. Each of the two banks include four cylinders 42'. The lower end of each cylinder 42' seats in surfaces 44' provided in the block section 14' to engage the lower end surface and exterior marginal lower end surface of each cylinder 42'.

The upper extremities of the cylinders 42' are fixedly engaged within openings formed in a sheet metal plate 46'. The plate 46' is essentially rectangular in shape bent along its longitudinal center line to form two longitudinally elongated areas having upper surfaces forming a shallow angle therebetween.

As best shown in FIG. 1, each piston and cylinder assembly 40' also includes a piston 48' mounted within an associated cylinder 42' for reciprocating axial movement in sealing engagement with the interior surface thereof as by piston rings 50'. Each piston 48' is pivotally connected, as by wrist pins 52', with the upper end of a piston rod 54'. The lower end of each piston rod 54' is pivotally connected to a shaft bright portion of a U-shaped crank section 56' of a crankshaft, generally indicated at 58'. Extending in vertical alignment with the legs of each U-shaped crank section 56' are counter-weight sections 60'. Since the piston and cylinder assemblies 40' diverge downwardly in two banks, there are two duplicate crankshafts 58', one for each bank.

Each crankshaft 58' includes axially aligned cylindrical bearing sections 62' at each end thereof and between adjacent crank sections 56'. The cylindrical bearing sections 62' have exterior surfaces thereof engaged with the interior surfaces of special separable bearings 64'. The exterior surfaces of which are engaged by corresponding mating 180° arcuate surfaces 30' and 38'. In this way, the two horizontally spaced crankshafts 58' are mounted for rotational movement on the frame structure 12' about parallel horizontally extending axes.

Figure 5:
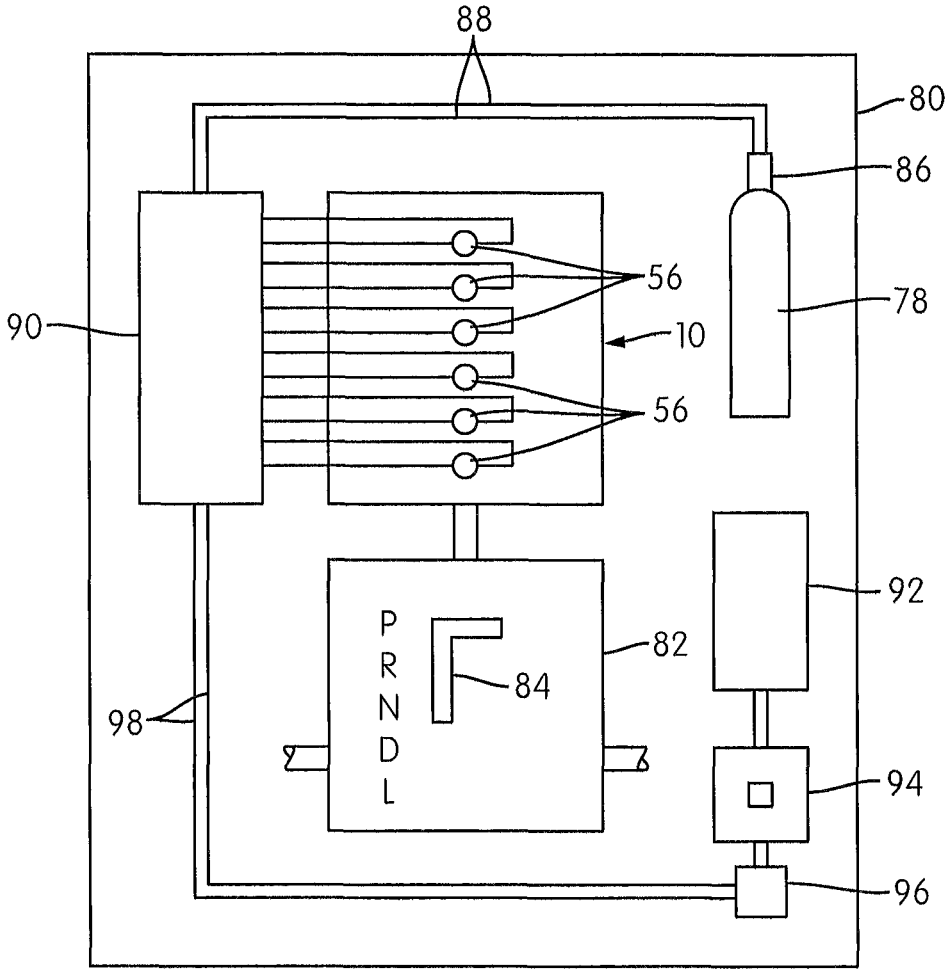
FIG. 5 is a right side elevational view of the engine shown in FIG. 1-4 with the cam drive guard shown in section.

Referring now more particularly to FIGS. 2 and 5, it can be seen that the cylindrical section 62' at the right end of each crankshaft 58' extends beyond the associated end walls 24' and 32' and has a spaced extremity supported on a wall extension 66'. Between the end walls 24' and 32' and the wall extension 66', each cylindrical end section 62' has mounted thereon a gear 68' and spacer 70'.

Figure 4:
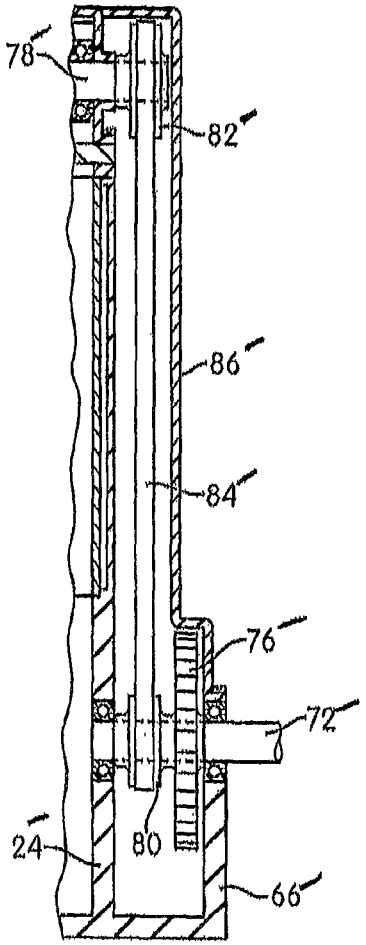
FIG. 4 is a fragmentary sectional view taken along the line 4-4 of FIG. 3.
Figure 6:
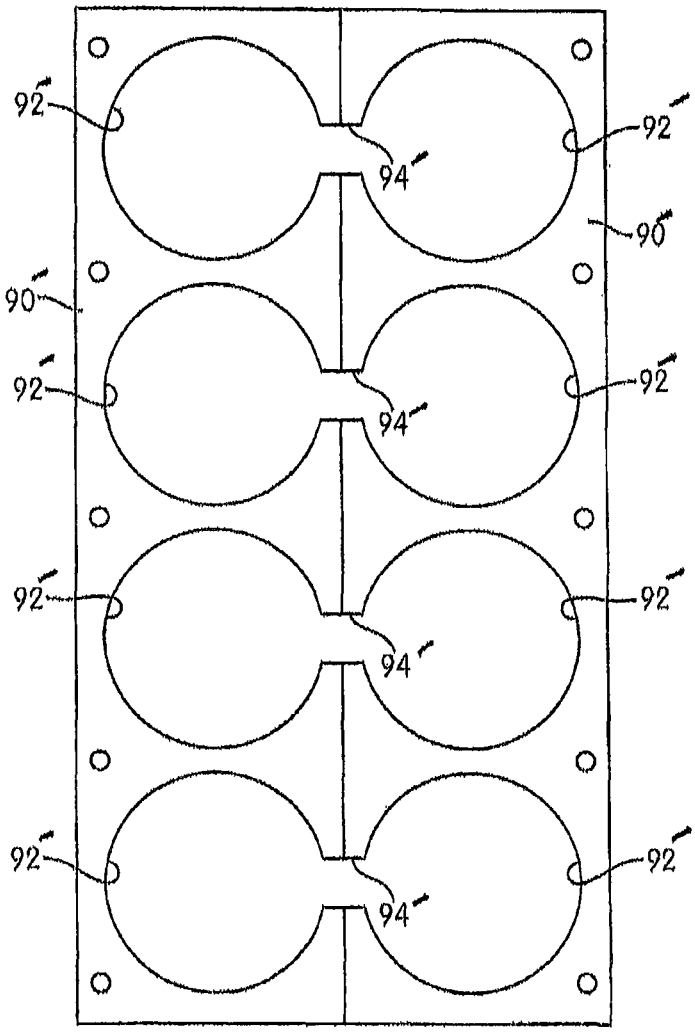
FIG. 6 is a layout view of the gasket of the engine viewed perpendicularly to the shallow angulated surface thereof.

As best shown in FIGS. 4 and 6, a main output stub shaft 72' has an inner end thereof suitably journaled between the end walls 24' and 32' in spaced relation between the crankshafts 58' and extends outwardly beyond the wall extension 66'. Mounted in vertical alignment with the wall extension 66' is an end cap wall extension 74' which, when fixed to the wall extension 66', provides with the wall extension 66' bearing support for the outwardly extending end of the stub shaft 72' as well as the associated extremities of the two crankshafts 58'.

Fixed on the stub shaft 72' in meshing relation between the two gears 68' on the crankshaft 58' is a third gear 76' enabling the stub shaft 72' to act as a main rotational output for the engine 10' when the crankshafts 58' are operated by the operation of the two banks of piston and cylinder assemblies 40'.

As best shown in FIG. 5, the stub shaft 72', which rotates at the same speed as the crankshafts 58', is used to drive a cam shaft 78' at a speed one half the common speed of the stub shaft 72' and crankshafts 58'. A sprocket and chain assembly may be used for this purpose, however, as shown in the assembly employed is a timing gear and pulley assembly including a small timing gear 80' fixed to the stub shaft 72', a double size timing gear 82' fixed on the camshaft 78' and an endless timing belt 84' trained about the timing gears 80' and 82'. The entire timing belt assembly 80', 82' and 84' is encased in a flanged timing belt guard 86' fixed to the associated end wall 32'.

Figure 3:
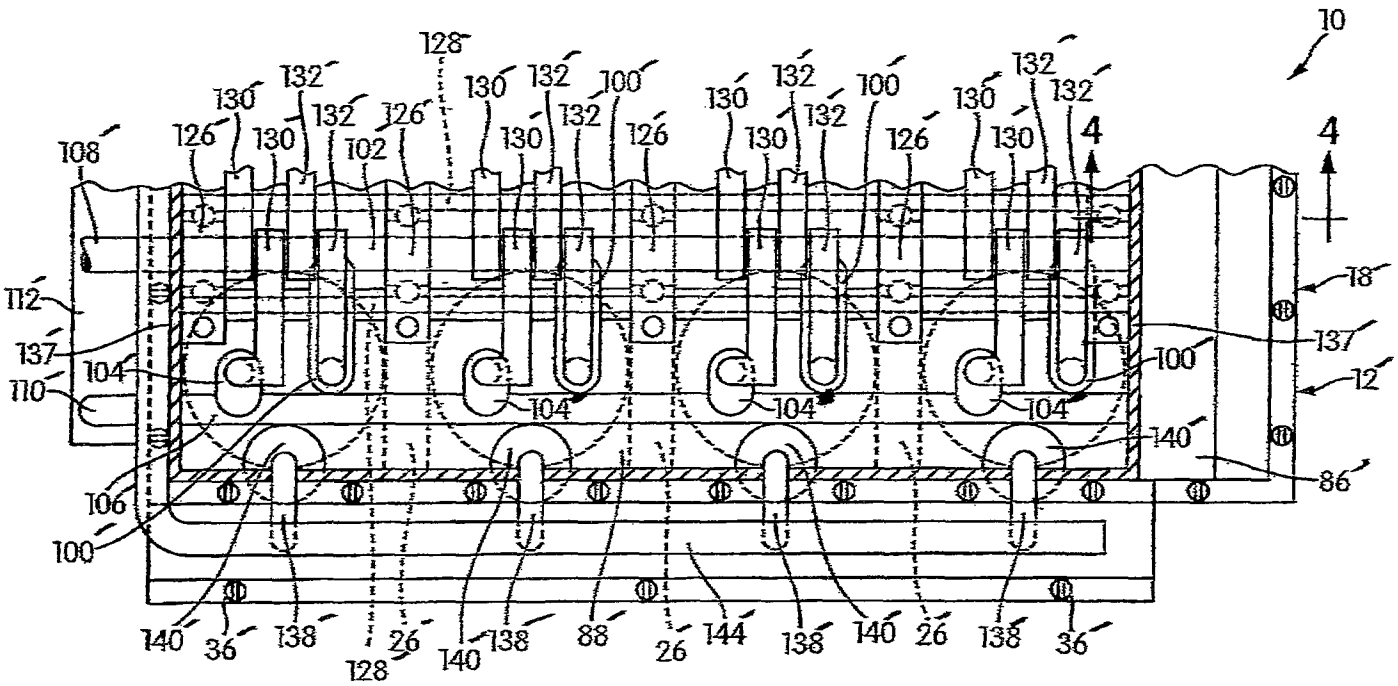
FIG. 3 is a fragmentary sectional view taken along the line 3-3 of FIG. 1.

Referring now more particularly to FIG. 3, the camshaft 78 is journaled in and forms a part of the head assembly 18'. The head assembly 18' includes a lower slightly angulated flat slab 88' having a lower surface which is complementary to the upper surface of the angulated plate 46'.

In accordance with the principles of the patented invention, an angulated gasket, generally indicated at 90', is fixed by suitable fasteners between the upper angulated surface of the plate 46' and the lower angulated surface of the slab 88'.

Referring now to FIG. 6, the gasket 90' is in angulated plate form and includes a series of four paired openings 92'. Extending between each pair of openings 92' is a passage forming cut out 94' (also in FIG. 1), when the gasket 90' is in final fixed relation between the plate 46' and slab 88', the four paired openings 92' communicate respectively with the upper ends of the four paired cylinders 42' so that the cut outs 94' provide a passage between each pair of paired cylinders 42'. That is, instead of the passage communicating a pair of adjacent cylinders 42' within the same bank, the passage herein communicates a pair of closely spaced cylinders (combustion chamber) from the two different banks.

Again referring to FIGS. 1, 2 and 3, the slab 88', which closes the upper end of the cylinders 42', has formed therein an inlet opening 96' leading into a combustion chamber portion in the upper end of each cylinder 42' and a spaced outlet opening 98' leading from the combustion chamber in the upper end of each cylinder 42'.

Extending over each outlet opening 98' from the upper surface of the slab 88' is a tubular structure 100' along the upper surface of slab 88' which leads inwardly to a central longitudinally extending tubular structure 102' defining an exhaust manifold for the engine.

Similarly, each inlet opening 96' has a tubular structure 104' disposed thereover on the upper surface of the slab 88'. The tubular structures 104' in one bank of cylinders extend away from the tubular structures 104' in the other bank. The outward ends of each bank of tubular structures 104' communicate with a manifold defining longitudinally extending tubular structure 106'.

As best shown in FIG. 3, an exhaust pipe 108' is connected to an open end of the exhaust manifold structure 102' and extends beyond the left end of the head assembly 18'. The two parallel inlet manifold structures 106' have one end correspondingly open to which are connected elbow pipes 110' leading to a centrally located inlet air filter assembly 112'.

Each inlet opening defines a downwardly facing frustoconical valve seat. An inlet valve 114' is mounted for movement with respect to each seat between an open position spaced from the seat and a closed position engaging the seat. Each inlet valve 114' includes a valve stem 116' extending upwardly therefrom through the associated inlet tubular structure 100. Surrounding the outwardly extending end of each inlet valve stem 116' between a washer fixed on the outward extremity of the valve stem 116' and the exterior of the associated inlet tubular structure 100' is a coil spring 118' which serves to spring bias the associated inlet valve 114' into its closed position.

In a similar manner, an outlet valve 120' with valve stem 122' and surrounding coil spring 124' is spring bias into a closed position with respect to each outlet opening 98'.

The inlet valves 114' and outlet valves 120' are moved out of their spring biased closed positions into their open positions by the operation of the camshaft 78'.

As best shown in FIG. 3, the camshaft 78' is rotatably supported in the head assembly 18' by a plurality of longitudinally spaced split supports 126' which also serve to fixedly support two rocker shafts 128' in a parallel relation to the camshaft 178' on opposite sides thereof.

The four inlet valves 114' in each bank are moved into their open positions by a corresponding four inlet rocker arms 130' pivotally mounted on an associated rocker shaft 128' and the four outlet valves in each bank are moved into their open positions by four outlet rocker arms 132' pivotally mounted on an associated rocker shaft 128'. To enable side by side rocker arms on each shaft to actuate longitudinally aligned valves of a valve engaging end of one of the adjacent rockers includes a longitudinally bent end.

The rocker arms 130' and 132' are mounted on their associated rocker shaft 128' so that the pivotal axis of each extends through a central portion thereof so that opposite free ends thereof can be engaged with the camshaft 78' and the washer fixed to the upper end of an associated valve 114' or 120'.

Each inlet valve 114' is moved into its open position at an appropriate time in the normal four stroke cycle occurring in the associated cylinder when the associated inlet rocker arm 130' is engaged by an inlet cam lobe 134' on the camshaft 78' and each outlet valve 120' is moved into its open position at an appropriate time in the normal four stroke cycle occurring when the associated outlet rocker arm 132' is engaged by an outlet cam lobe 136' on the camshaft 78'.

The head assembly 18' including the air inlet system up to the elbow pipes 110', the exhaust system up to the exhaust pipe 108', the camshaft 78' and mount 126' up to the end on which timing gear 82' is mounted and all of the rocker arms 130' and 132', the rocker shafts 128', valve stents 116' and 122' and valve springs 118' and 124' are enclosed within a cover member 137' having its lower open end provided with an exterior peripheral mounting flange through which the cover member 137' is bolted to the upper periphery of the slab 88'.

Figure 7:
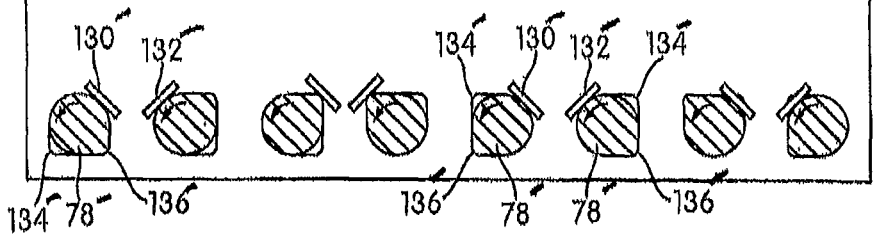
FIG. 7 is a chart designating the direction of piston movement and cycle events for each piston and cylinder assembly of the engine including corresponding cross-sections of the camshaft.

Referring now more particularly to FIG. 7, there is shown therein a chart showing for each of four consecutive 180° rotational movements of the crankshafts 58', the direction of piston movement, either up-U or down-D, for each piston and cylinder assembly 40' and the cycle event—CE (F=fire, E=exhaust, I=inlet, C=compression) occurring in each piston and cycling assembly 40'.

The chart also includes for each piston and cylinder assembly 40', illustrations of the configuration of the camshaft. The illustrations show the relative circumferential position on the camshaft of the exhaust cam lobes in cross section and the related inlet cam lobes in elevation to indicate the opening of the exhaust valves during the exhaust event and the opening of the inlet valves during the inlet event without regard to their exact beginning or end which is in accordance with accepted practice.

Each communicated (i.e., across the banks) pair of piston and cylinder assemblies 40' is fired together for one 180° turn during each of four consecutive 180° turns of the crankshafts 58' and the firings of a different pair take place in each of the four consecutive 180° turns. As shown, the order of firing is 1-3-4-2.

Figure 8:
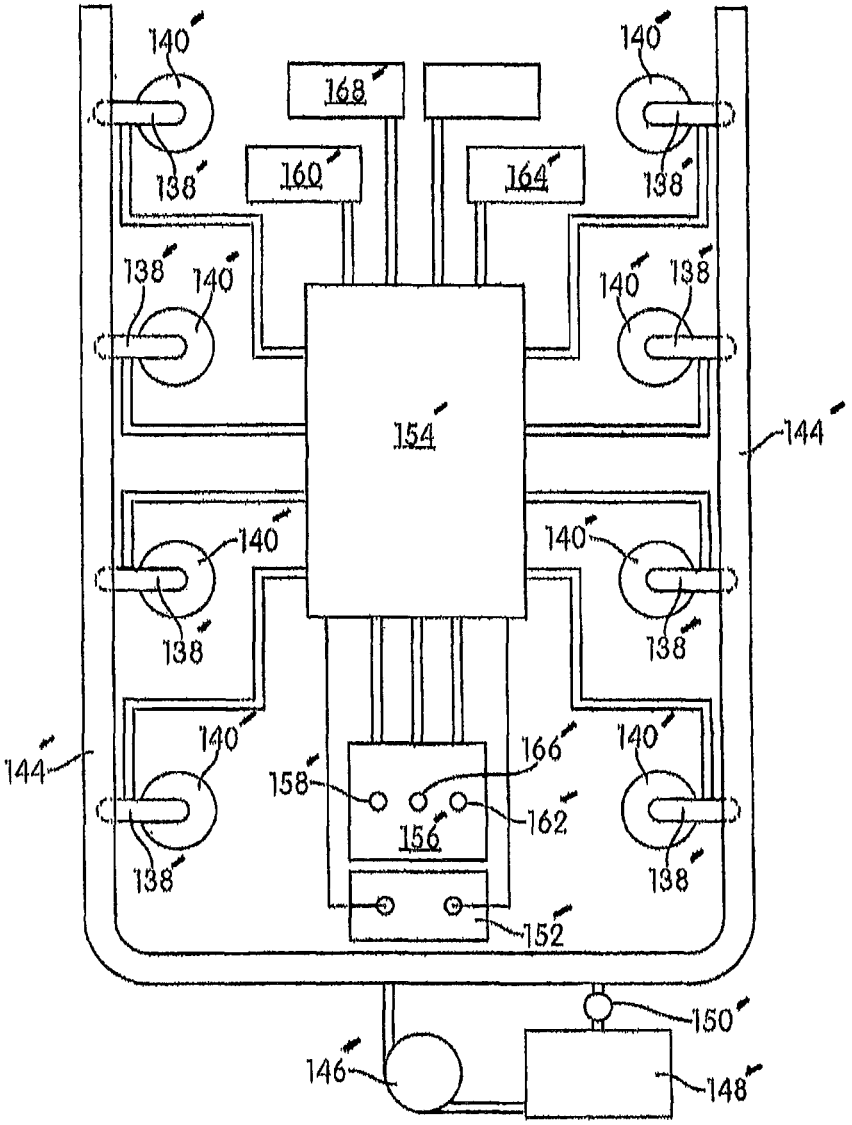
FIG. 8 is a somewhat schematic view of the fuel injecting system and the computer system for controlling the fuel injecting system.

Referring now more particularly to FIG. 8, there is shown therein the manner in which fuel injection skipping is applied to each double firing event of each pair of piston and cylinder assemblies 40' in accordance with the invention.

FIG. 8 illustrates an injector 138' for each piston and cylinder assembly 40' in their relative positions, each injector 138' is preferably of the type having a cylindrical body with a conical ejecting nozzle which is opened and closed by an electrically actuated solenoid valve. As shown, each injector body has angulated exterior circular mounting flange which fits within a mating recess in the upper surface of the slab 88'. A nozzle recess extends from each mating recess through the slab 88. In this way, the nozzle of each injector 138' is positioned to inject fuel therethrough into the associated combustion chamber in the direction of a swirl chamber 142' formed in the upper surface of the associated piston 48' when in its top dead center position.

Injecting fuel into a swirl chamber 142' in the piston 48' is characteristic of diesel operation. Wherein the compression ratio of each piston and assembly 40' is such that at the end of the compression event, the air in the combustion chamber is at a temperature and pressure to cause auto ignition when the fuel is injected therein.

While the engine 10' is shown as being diesel operated with compression ignition, the engine could be made to operate on a conventional spark ignition basis with a lesser compression ratio and a positioning of the fuel injectors with mating air injectors to direct an appropriate air fuel mixture into the combustion chamber through the open inlet valve during the inlet stroke.

It will also be understood that while the engine is disclosed as inverted V-8, it could be made into an inverted V-6 by appropriate changing the crank portions of the crankshafts from the 180° shown to 120°. Other numbers of pistons/cylinders are possible.

Referring now back to FIG. 8 of the drawings, the cylindrical end of each injector 138' opposite of its nozzle is connected to a fuel containing manifold 144'. The fuel in the manifold 144' is maintained at a predetermined pressure by the output of a pump 146' drawing fuel from a supply 148' which is connected to manifold through a pressure relief valve 150'.

The opening and closing of the solenoid valves determines the amount of fuel injected by each of the injectors 138'. The solenoids are normal spring biased into a closed position and opened when the solenoid valves are electrically energized.

The further descriptions of the skipping control assume that the engine is installed as the motive power of a vehicle. The solenoid actuating electrical energy comes from the battery of the vehicle shown at 152' in FIG. 8. As shown, the battery 152' is connected to a computer 154'. The computer 154' is programmed either by software or circuit logic to receive one of three activating input signals. The three input signals come from either a three button manual switch assembly 156' or a number of automatic vehicle condition sensors or both. The sensors, utilized, for example, can be a sensor 160' which senses when the vehicle is on an upward incline or a downward incline, or a sensor which senses the actuation of the accelerator pedal or the actuation of the brake pedal.

In any event, preferably there are at least three input signals that achieve three different skipping patterns. A first skipping pattern is simply no skipping in which case the computer 154' is programmed to activate all of the solenoid valves at the appropriate time. This constitutes a full power mode which is desirable when, for example, the vehicle is going up a hill. This full power mode can be input into the computer 154' either by manually pushing button 158' of the three button assembly 156' or by the actuation of a level sensor 160'.

A second skipping pattern is one which can be referred to as a normal operating mode. The input to the computer is by manually pushing button 162' of the three button assembly 156' or by a sensor 164' which senses the turning on of the engine. When the computer 156' receives the normal mode input signal, the computer, 156' is programmed to alternately skip during consecutive two full rotations of the crankshafts between the injectors 138' of one bank of piston and cylinders 40' and then the injectors 138' of the piston and cylinder assemblies 40' of the other bank. In short, normal mode operation involves the saving of one half of the fuel used in the full power mode. However, because of the double expansion which takes place because of the passages 94' enabling the combustion comparison in one cylinder of a communicated pair to drive the piston in the other cylinder of the pair, more than one half power is maintained as discussed in the '769 patent. Alternatively, not all the injectors of one bank are skipped simultaneously. In some embodiments, some of the skipped (i.e., those not receiving a fuel injection) are in one bank, while some are in the other bank, this better balances out the combustion locations within the engine frame structure.

A third skipping pattern can be termed a coasting mode. The input for this mode can come from, for example, manually pushing button 166' of the three button assembly 156' or from the actuation of sensor 168' sensing release of the accelerator pedal. When the computer receives this signal two of the four pairs of piston and cylinder assemblies (e.g. 1 and 2) are alternately skipped as in the normal mode while the other two (e.g. 3 and 4) are both skipped entirely, in this mode, there is a double fire every 360° of the crankshaft turning and a fuel saving of three quarters of the full power mode. Again, the power loss should be less than three quarters of full power.

The description above refers to alternating the one cylinder receiving the injection when two cylinders are operatively receiving an injection and a skipped injection. This alternating method of proceeding is preferred because it achieves more uniform heat balance and more even part wear between the two assemblies involved. The alternation preferably is programmed to take place every predetermined number of piston cycles. The predetermined number of cycles can be any number. A preferred range of number of cycles is 1-10 with five being a preferred number.

It will be understood that the engine may be provided with a conventional lubricating and cooling system.

Figure 14:
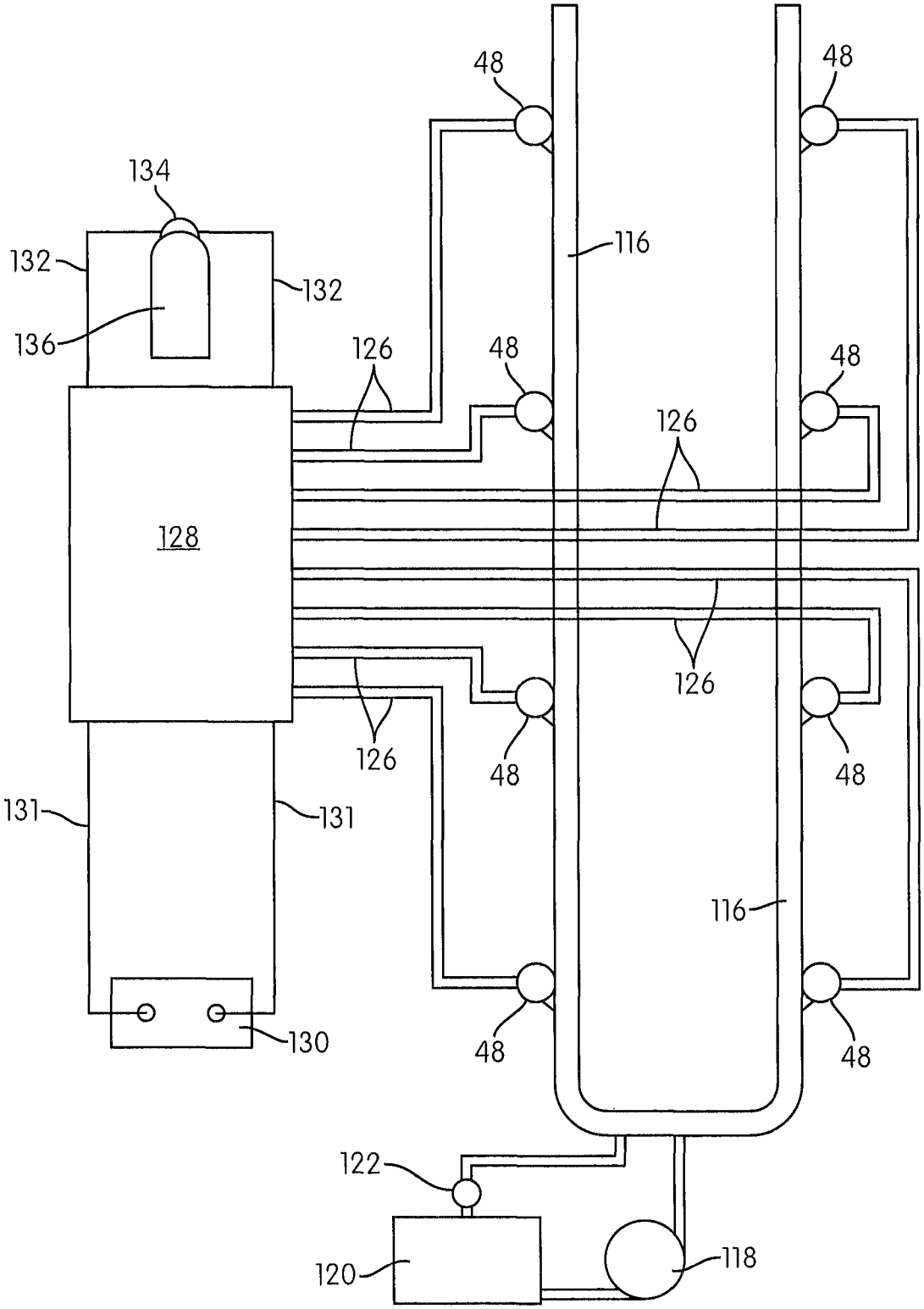
FIG. 14 is a somewhat schematic view of the fuel injecting system and the computer system for controlling the fuel injecting system.

Referring now to FIG. 14 of the drawings, the cylindrical end of each injector 48 opposite of its nozzle is connected to a fuel containing manifold 116. The fuel in the manifold 116 is maintained at a predetermined pressure by the output of a pump 118 drawing fuel from a supply 120 which is connected to manifold 116 through a pressure relief valve.

Electrically operated solenoid valves 124 are mounted in opening and closing relation to the nozzle of each injector 48. The opening and closing of the solenoid valve 124 determines the amount of fuel injected by each of the injectors 48. The solenoid valves 124 are normal spring biased into a closed position and opened when the solenoid of the valves 124 is electrically energized.

As shown schematically in FIG. 14, the electrical energization of the solenoid of the valves 124 comes from lines 126 leading from a computer 128 which, in turn, gets its energy from a battery 130 through lead lines 131. The computer 128 is programmed to send electrical output signals over lines 126 of a predetermined duration to effect a predetermined amount of fuel injection in properly timed cyclical relation. The computer 128 is programmed to send the output signals to effect fuel injection through lines 132 in response to input signals received from a pedal position sensor 134 capable of transmitting signals indicative of the position of an accelerator pedal 136.

Figure 15:
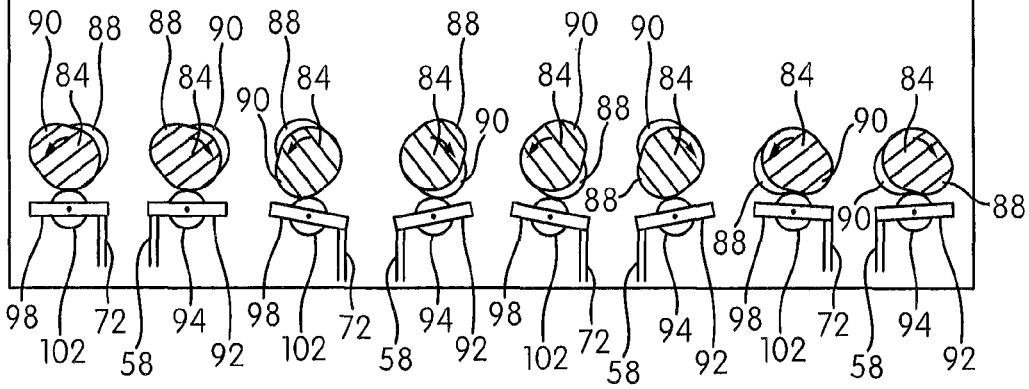
FIG. 15 is a chart designating the direction of piston movement and cycle events for each piston and cylinder assembly of the engine of FIG. 9 including corresponding cross-sections of the camshaft.

Referring now more particularly to FIG. 15, there is shown therein a chart showing for each of four consecutive 180° rotational movements of the crankshafts 32, the direction of piston movement, either up-U or down-D, for each piston and cylinder assembly 14 and the cycle event—CE (F=fire, E=exhaust, I-inlet, C=compression) occurring in each piston and cycling assembly 14.

The chart also includes for each piston and cylinder assembly 14, an illustration of the configuration of the inlet and outlet cam 88 and 90. The illustrations show the relative circumferential position on the camshaft 84 of the outlet cam 90 and the related inlet cam 88 to indicate the opening of the outlet valves 70 during the exhaust event and the opening of the inlet valves 56 during the inlet event without regard to their exact beginning or end which is in accordance with accepted practice.

Each communicated pair of piston and cylinder assemblies 14 is fired together for one 180° turn during each of four consecutive 180° turns of the crankshafts 32 and the firings of a different pair take place in each of the four consecutive 180° turns. As shown, the order of firing is 1-3-4-2.

While the engine 10 is shown as being diesel operated with compression ignition, the engine could be made to operate on a conventional spark ignition basis with a lesser compression ratio and a positioning of the fuel injectors with mating air injectors to direct an appropriate air fuel mixture into the combustion chamber through the open inlet valve during the inlet stroke.

It will be understood that while the engine is disclosed as an inverted V-8, it could be made into an inverted V-6 by appropriately changing the crank portions of the crankshafts from the 180° shown to 120°. Other numbers of piston/cylinders are possible.

It will also be understood that the engine may be provided with a conventional lubricating and cooling system.

Referring now more particularly to FIGS. 9-17 of the drawings, there is shown in FIGS. 9-13 thereof another preferred embodiment of an inverted V-8 internal combustion engine, generally indicated at 10, which embodies the principles of the present invention. The engine 10 includes a frame assembly, generally indicated at 12, having eight crankshaft connected piston and cylinder assemblies mounted therein, each of which is generally indicated by the reference numeral 14.

The frame assembly 12 includes a lower pan component 16, a central block component 18 and an upper head component 20.

The eight piston and cylinder assemblies 14 include eight cylinders 22 mounted in the block component 18 in two banks of four inline cylinders 22. The cylinders 22 of the two banks have their longitudinally axes dispose in two common bank planes which are disposed on opposite sides of a bisecting vertical plane in upwardly converging angular relation with respect to one another (i.e., an inverted V configuration).

Figure 10:
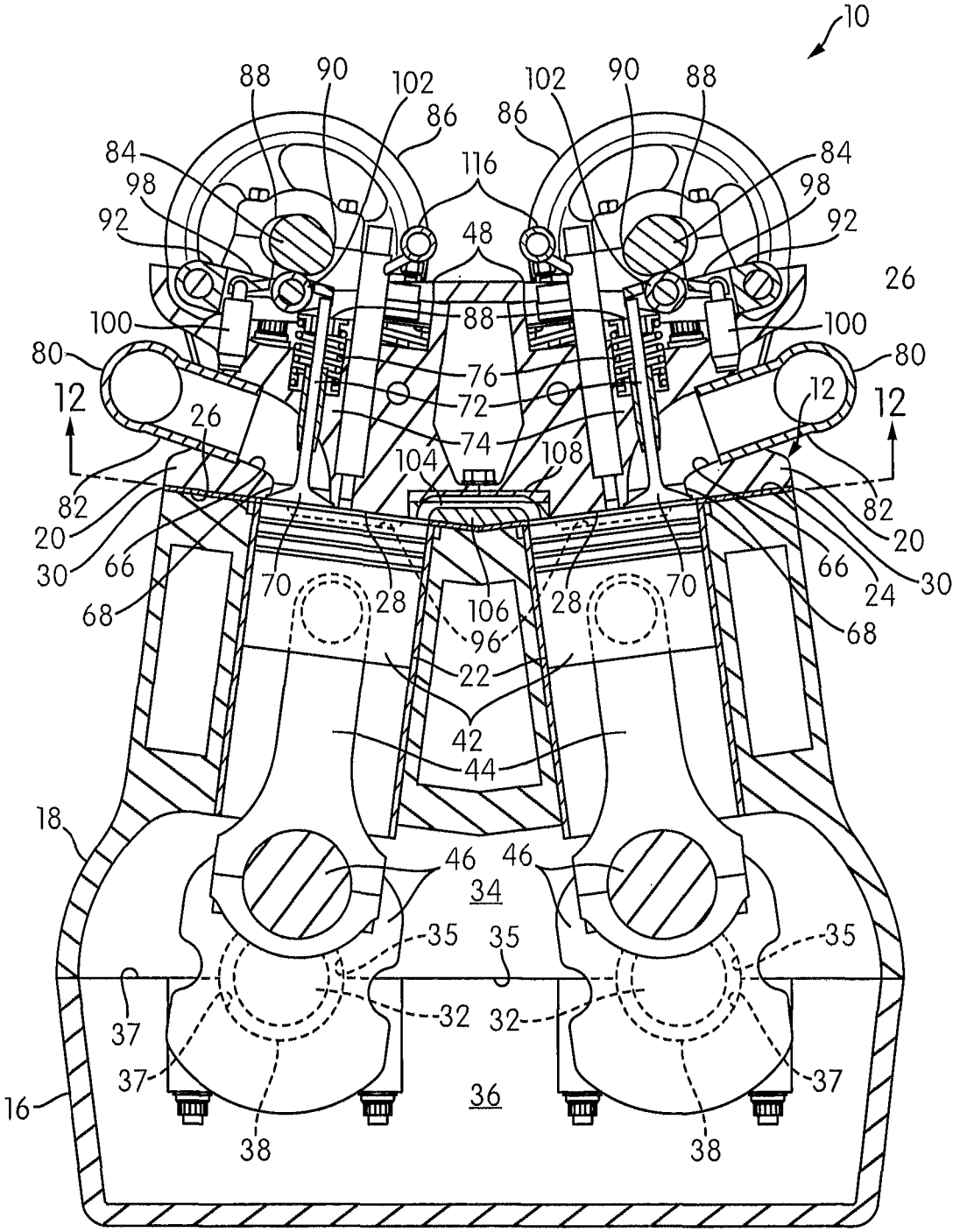
FIG. 10 is a sectional view taken along line 10-10 of FIG. 9.
Figure 11:
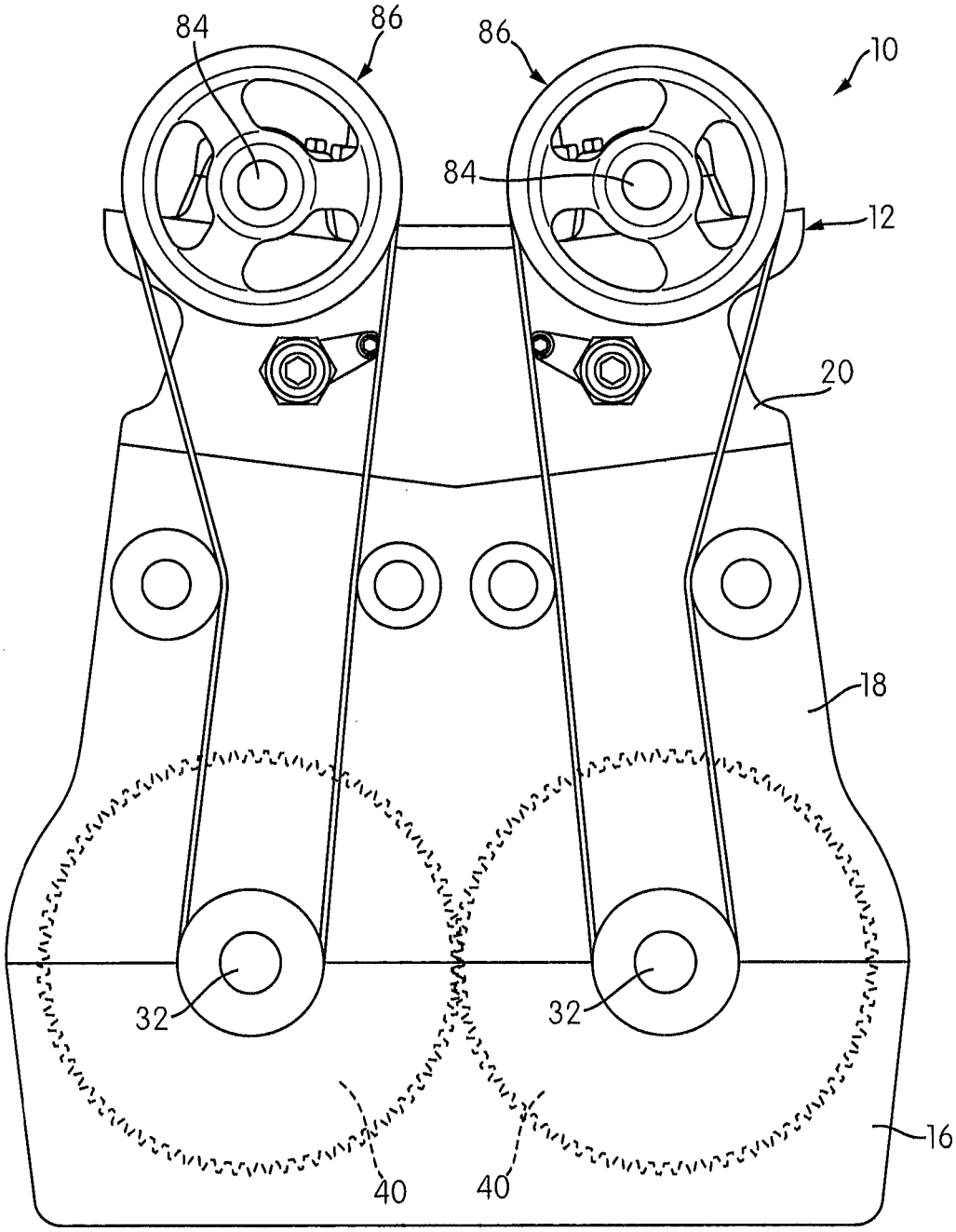
FIG. 11 is a sectional view taken along the line 11-11 of FIG. 9.

As best shown in FIGS. 10 and 11, the two banks of four cylinders 22 have upper ends which are open and disposed within two angularly related planes perpendicular to the two bank planes.

The block component 18 which carries the cylinders 22 has structure defining upwardly facing surface means in the form of first and second angularly related planar surfaces 24 disposed within the aforesaid two angularly related planes.

The head component 20 is detachably fixedly supported on the block component 18 and has two angularly related downwardly facing planar surfaces 26 which sealingly engage the two angularly related upwardly facing surfaces 24 of the block component 18. The two angularly related downwardly facing surfaces 26 include portions 28 which cover the open ends of the cylinders 22. The remainder of the surfaces 26 are sealingly engaged with coextensive portions of the upwardly facing surfaces 24 by means of two separate gaskets 30 one in each of the two angularly related surfaces 24 and 26.

The block component 18 is detachably fixedly supported on the pan component 16 which, in turn, is configured to rest on and be secured to a horizontal supporting surface. The block component 18 cooperates with the pan component 16 when fixedly supported thereon to rotatably support two parallel transversely spaced crankshafts 32.

To this end, the block component 18 includes spaced vertical wall structures 34 which extend transversely in a direction perpendicular to the axis of rotation of the crankshafts 32 and define downwardly facing lower surface means which includes two transversely spaced semi-cylindrical bearing engaging surfaces 35, shown in dotted lines in FIG. 10. The pan component 16 includes correspondingly spaced vertical wall structures 36 which define upwardly facing surface means including two transversely spaced semi-cylindrical bearing engaging surfaces 37 also shown in dotted lines in FIG. 10. FIG. 10 also illustrates in dotted lines, bearings 38, which are held in place between the cooperating semi-cylindrical surfaces 35 and 37, and serve to rotatably support the respective crankshafts 32.

Figure 9:
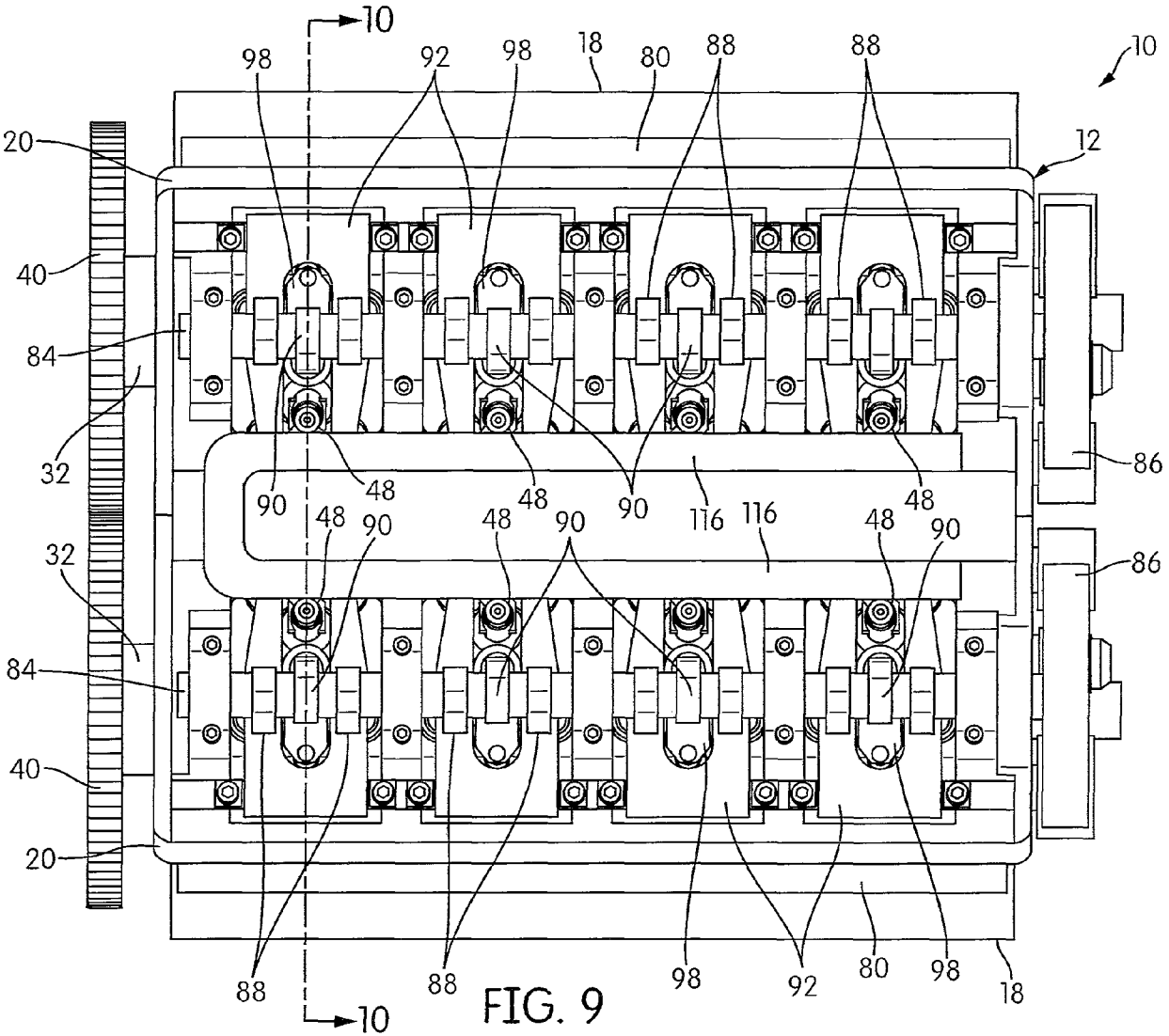
FIG. 9 is another top plan view of another preferred embodiment of an inverted V-8 engine embodying the principles of the present invention with the top cover removed.
Figure 12:
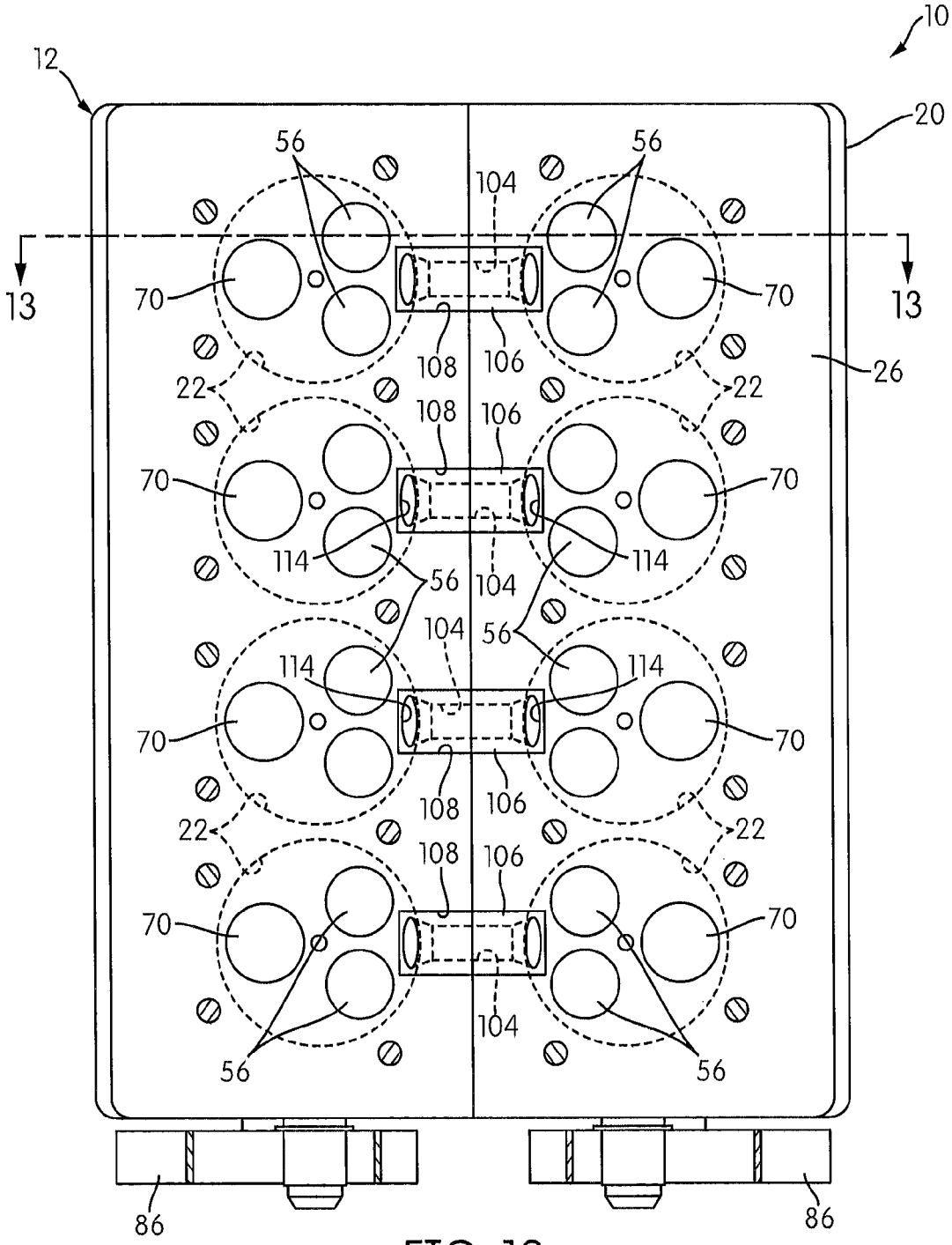
FIG. 12 is a right hand end view of the engine shown in FIG. 9.

As best shown in FIGS. 9 and 12, the two crankshafts 32 are drivingly connected together so as to have the same rotational speed. To this end, each crankshaft 32 has mounted on an outlet end thereof a gear 40. As shown, the gears 40 are of the same size and disposed in meshing engagement with one another, causing the two crankshafts 32 to rotate in opposite directions which is advantageous in providing selective output rotation in either direction.

The eight piston and cylinder assemblies 14 also include eight pistons 42 slidably sealingly mounted in the eight cylinders 22. The four pistons 42 associated with one bank of cylinders 22 are pivoted to one end of four piston rods 44 which, in turn, are rotatably connected at the other ends thereof to four crank arm portions 46 of one of the two crankshafts 32. The four pistons 42 associated with the other bank of cylinders 22 are pivoted to one end of four other piston rods 44 which, in turn, are rotatably connected at the other ends thereof to four crank arm portions 46 of the other one of the two crankshafts 32. The fact that the crankshafts 32 rotate in different directions does not prevent the pistons 42 of each cooperating pair of assemblies 14 from having simultaneous movements which they are geared together to do.

From the above, it can be seen that the eight crankshaft connected piston and cylinder assemblies 14 include two crankshafts 32, eight cylinders 22, eight pistons 42, and eight piston rods 44. The eight assemblies 14 also include eight fuel injectors 48, one associated with each cylinder 22.

Figure 13:
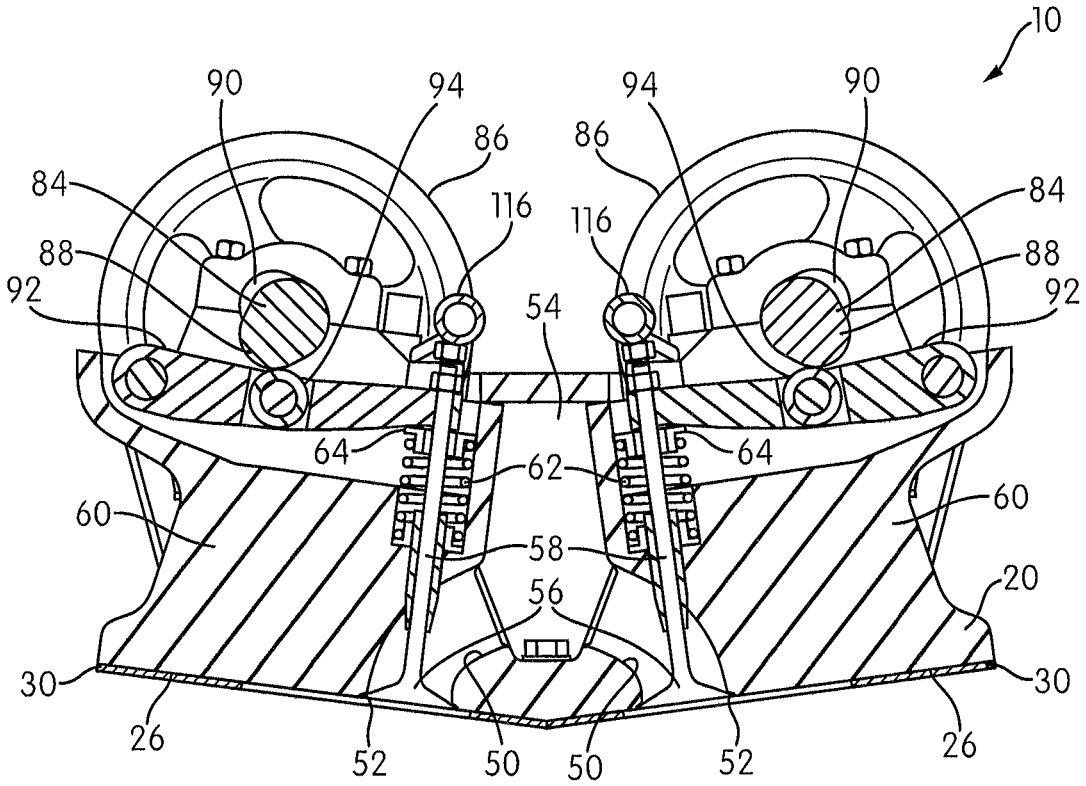
FIG. 13 is a bottom plan view of the head component of the engine shown in FIG. 9.

The positioning of each injector 48 in its associated assembly 14 in relation to the cam shaft actuated valving which accomplishes the conventional four cyclical events in each assembly during two revolutions of the crankshafts 32 is best shown in FIGS. 10 and 13. Each portion of the head component 20 defining a covering surface portion 28 for an open end of each cylinder 22 is formed with two longitudinally spaced inlet openings 50. Each inlet opening 50 is of arcuate configuration having one communicating with the open end of an associated cylinder 22 and defining a downwardly facing frustoconical inlet valve seat 52.

As best shown in FIG. 14, the two inlet openings 50 of each bank of cylinders 22 open into the inner half of the cylinders 22 in the bank. In this way, the inlet openings 50 of both banks are adjacently opposite one another so that their opposite ends communicate with a common inlet plenum chamber 54 extending longitudinally in the upper central portion of the head component 20.

Mounted in opening and closing relation to each valve seat 52 is an inlet poppet valve 56 having a valve stem 58 which extends upwardly through the associated inlet opening 50. Each inlet valve stem 58 extends upwardly from the associated inlet opening 50 through a wall portion 60 formed in the head component 20. A coil spring 62 surrounds each inlet valve stem 58 and has in its power end in engagement with the associated wall portion 62 and its upper end engaged with a washer 64 fixed to the associated valve stem 58. In this way, each inlet poppet valve 56 has its valve portion normally spring biased into closed sealing relation to the associated inlet valve seat 52.

Each pair of inlet openings 50 is associated with a single, somewhat larger outlet opening 66. As best shown in FIGS. 10 and 12, each outlet opening 66 is centered in transversely spaced relation in the outer half of the open end of the associated cylinder 22. As before, each single outlet opening 66 terminates in an outlet valve seat 68 and an outlet poppet valve 70 is associated with each valve seat 68. As before, each outlet poppet valve 70 includes an outlet valve stem 72 which extends through the associated outlet opening 66 and a wall section 74 of the head component 20.

As before, each outlet poppet valve 70 is spring biased so that its valve portion engages the associated outlet valve seat 68 in sealed relation. Thus, a coil spring 76 surrounds each outlet valve stem 72 in engagement between the wall section 76 and a washer 78 fixed to the end of each outlet valve stem 72.

As best shown in FIG. 10, each outlet opening 66 is arcuate in shape and the end opposite from the valve seat 68 opens transversely outwardly. The open ends of each bank of outlet openings 66 is communicated with an outwardly disposed longitudinally extending outlet manifold tube 80 carried by the head component 20. Each outlet manifold tube 80 is communicated with the open ends of the associated bank of outlet openings 66 by short tubes 82 extending transversely from the associated manifold tube 80 into the open ends of the associated outlet openings 66.

The two inlet poppet valves 56 and single outlet poppet valve 70 associated with each of the four assemblies 14 of each bank are moved in cyclically timed relation by a cam actuating means including a cam shaft 84 and a plurality of cam followers hereinafter to be more fully described.

As best shown in FIG. 11, each cam shaft 88 is suitably journaled in the head component 20 and is driven by an associated crankshaft 32 at one half the speed thereof by means of a timing belt assembly 86.

Each cam shaft 84 includes a series of inlet and outlet cams or camlobe surfaces 88 and 90 formed thereon for moving the associated inlet and outlet valves 58 and 70 into open positions against the spring bias thereof in proper cyclically timed relation.

The cam followers, as shown, are in the form of levers. The two inlet valves 56 associated with each assembly 14 are moved by a U-shaped lever 92 having the free ends of the legs of the U-shape connected to the upper ends of the two associated inlet valve stems 58 (see FIG. 13). The opposite bright portion end of each U-shaped lever 92 is pivotally mounted on a structural wall portion of the head component 20.

The central portion of each leg of each U-shaped lever 92 is bifurcated and has a shaft mounted roller 98 therein in a position to be engaged by inlet cams 88 of the associated cam shaft 84.

The U-shaped configuration of each lever 92 provides space between the legs thereof to mount the associated injector 48 vertically downwardly so that its lower discharge end can extend centrally into the open end of the associated cylinder 22, enabling the injected fuel to mix with air within a recess formed in the upper end of the associated piston 42 which is brought to an auto ignition pressure and temperature at the end of the compression stroke.

The U-shaped configuration also provides space between the legs of each U-shaped lever 92 within which to position an outlet cam follower in the form of an adjustable outlet valve moving lever 98. Each outlet lever 98 has an inner end connected to the upper end of the associated outlet valve stem 72, an opposite outer end pivoted on the upper end of a hydraulic adjusting unit 100 mounted in the head component 20 and a central bifurcated portion provided with a cam actuated outlet roller 102 disposed in longitudinal alignment with an associated outlet cam 90 of the associated cam shaft 84.

Figure 16:
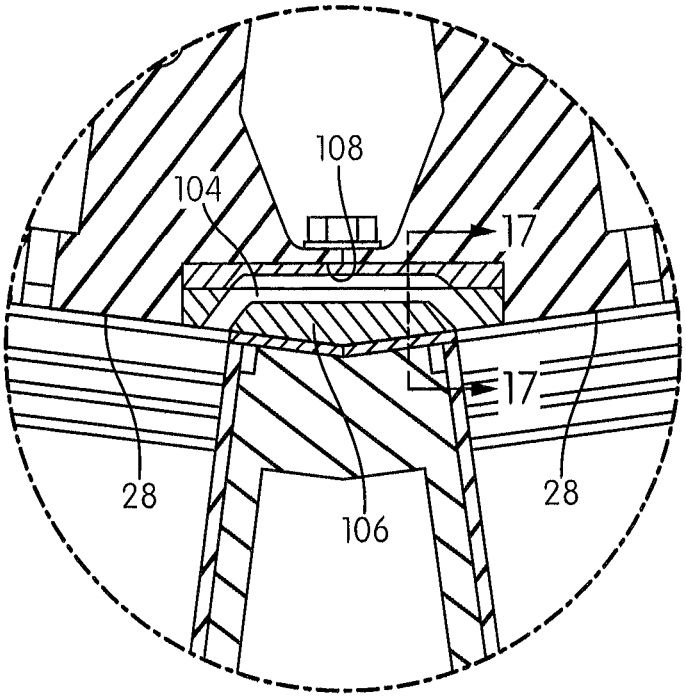
FIG. 16 is an enlarged view of the passage defining an insert shown in FIG. 10 together with portions of the surrounding structure.
Figure 17:
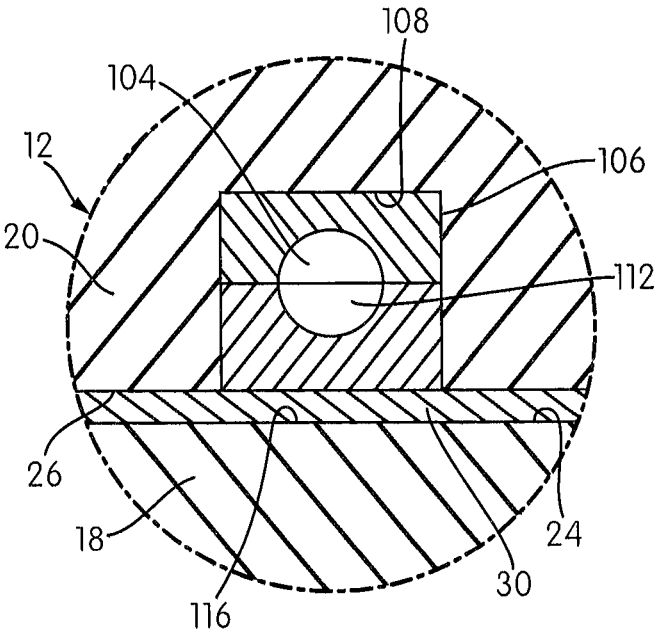
FIG. 17 is a sectional view taken along the line 17-17 of FIG. 16.

Referring now more particularly to FIGS. 12, 16 and 17 in accordance with the teachings of the '769 patent, the adjacent upper open ends of each pair of cylinders 22 which define the combustion chambers thereof are communicated by a passage, generally indicated at 104. Preferably, as shown, each passage 104 is formed in a two-piece insert 106 fixedly mounted within a recess 108 formed in the head component 20.

Each recess 108 is disposed in the portion of the head component 20 overlying the structure of the block component 18 between the open ends of an associated pair of cylinders 22. Each recess 108 is defined by inverted perpendicularly related U-shaped walls which open downwardly toward an interim shallow U-shaped wall surface 110 between the two planar surfaces 24 of the block component 18.

The passage 104 in each insert 106, as shown in FIG. 10, includes a longitudinally extending central cylindrical portion 112 having opposite angularly downwardly extending flared end portions 114 which are in open communication with the upper open ends of the associated pair of cylinders 22.

Preferably, each insert 106 is made of a heat resistant material, for example inconel and is cut into pieces horizontally along the axis of the central passage portion 114. This two-piece construction enables the surfaces which define the passage 104 to be polished. Each two-piece insert 106 fits snuggly in the associated recess 108 and is fixedly retained therein by engagement with the associated surface 110 when the head component 20 is fixed onto the block component 18 by a series of bolts (not shown).

It can thus be seen that there has been provided an internal combustion engine 10 having two banks of four piston and cylinder assemblies 14 arranged in an inverted V configuration so that there are four cooperating pairs of assemblies 14, each pair having (1) cylinders 22 with adjacent combustion chambers intercommunicated by a passage 104 extending therebetween, and (2) crankshaft-driven pistons 42 in the cylinders 22 movable toward and away from the combustion chambers thereof through successive cycles, each including a compression stroke followed immediately by a power drive stroke. A computer-controlled fuel injector 48 capable of being selectively controlled to operate either to inject fuel into (a) both cylinders 22 of the pair to establish therein a double fire single expansion mode (1) or (b) into only one cylinder of a pair to establish therein a single fire double expansion mode (2). The single fire double expansion mode may also be referred to as a shared power drive event because the power generated by combustion in one cylinder of the pair is shared with the other cylinder via passage 104.

Preferably, when operating in mode (2), the one cylinder receiving the injection is alternated between the pair every predetermined number of piston cycles. This number is predetermined in random fashion in accordance with the teaching of U.S. Pat. No. 4,172,434, the entire disclosure of which is hereby incorporated by reference into the present specification.

Figure 18:
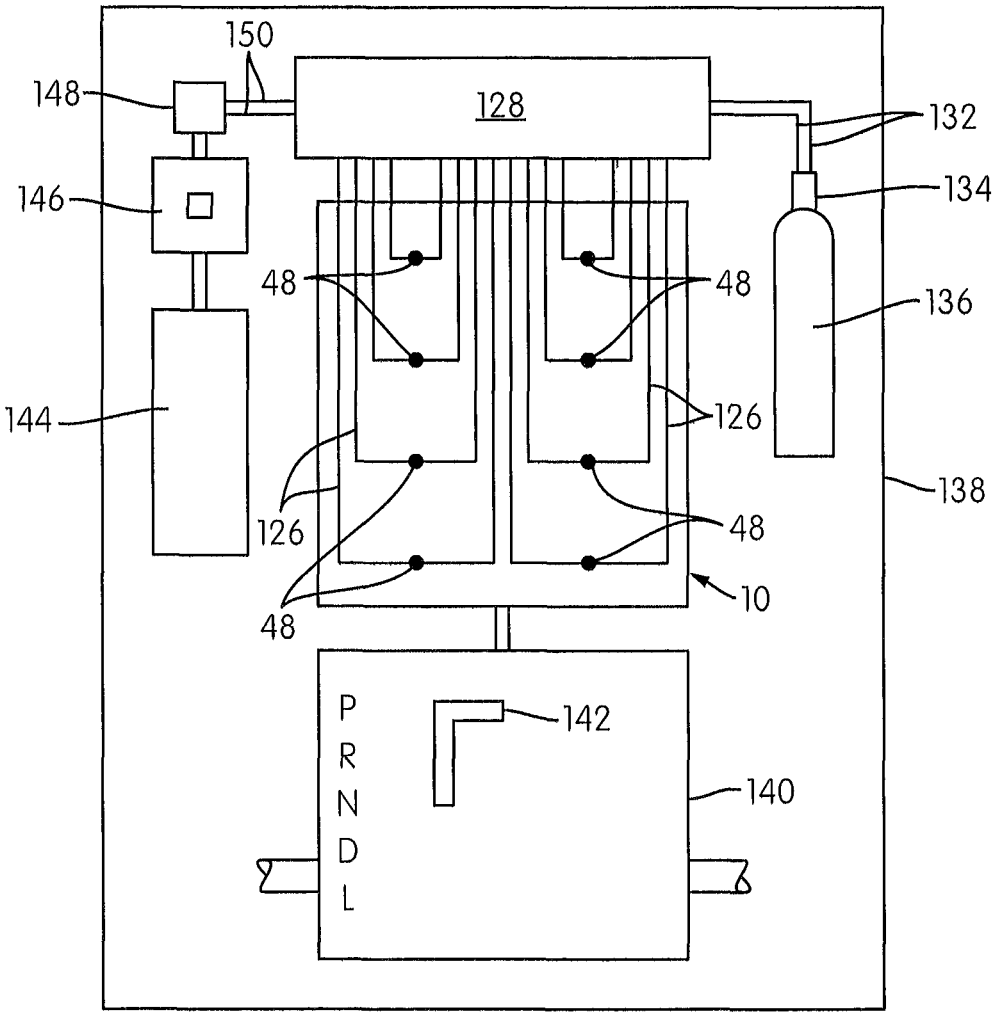
FIG. 18 is a schematic view of a vehicle with the engine of FIG. 9 mounted therein.

Referring now more particularly to FIG. 18, the drawing shows an outer rectangle which schematically represents a vehicle 138 within which the engine 10 is mounted so as to be operated in accordance with the method of the present invention. It will be understood the method of the present invention is equally applicable to the engine 10'. Indeed, the method to be described in connection with engine 10 is preferred for the engine 10' in lieu of the methods of operation described during the description of the engine 10'.

The vehicle 138 is shown schematically to include the engine 10 with its eight injectors 48 connected by lines 126 to the battery-powered computer 128. The engine 10 is shown schematically to be drivingly connected to a convention lever controlled transmission 140 which, in turn, is selectively connected and disconnected to the vehicle 138.

The assembly of the transmission 140 is shown as including a conventional gear shift lever 142 with an exemplary small truck PRNDL position option. The N position stands for neutral and is the "idle" position where the transmission 140 is disconnected from the vehicle so as not to be moved by the engine 10 while the engine 10 is in operation, the R, D and L positions are the drive positions [R for reverse, D for drive (normally) and low (for rare occasions when greater torque is required for the vehicle]. When the lever 142 is in a drive position, the transmission 140 is connected to drive the vehicle 138 for movement by the engine 10.

Still referring to FIG. 18, the vehicle 138 is preferably provided with a conventional cruise control system, generally indicated at 144, which includes an actuating unit 146 capable of actuating the system 144 at a set minimum speed. As is known, the driver may opt to exceed that speed while the cruise control is still active by depressing the accelerator pedal to a point to selects more power/speed. The actuation of the actuating unit 146 to operate the cruise control system 144 is a matter of vehicle driver judgment.

As best shown in FIG. 18, the cruise control system 144 of the vehicle 138 has a cruise control operation sensor 148 operatively associated with the actuating unit 146 of the system 144. The sensor 148 senses when the actuating unit 146 is actuated and the continuation of the actuation until the cruise control system 144 is deactuated. As long as the computer 128 receives, via leads 150, a signal from the sensor 148 indicative of continued activation the pedal position signals being received are no longer used to control the fuel delivery to the engine, unless the accelerator is depressed to demand more speed.

Preferably, because cruise control is set for a steady speed, a significant amount of torque is not required. Thus, the engine can be operated in a lower power mode usually. Consequently, when the cruise control system 144 is actuated and operative, a 50% fuel saving can normally be achieved with the power available being greater than 50% by virtue of the pair of shared power drive events occurring in four pairs of piston and cylinder assemblies (an estimated 70%). Of course, since many cruise control systems have the ability to temporarily suspend the set speed, and later resume it, increased power through the other higher power modes may be used to achieve the set speed as well.

When the cruise control system 144 is deactuated and not operating, the vehicle 138 is operated normally in the manner hereinafter described which includes the method of operating the engine 10 or 10' in accordance with the principles of the present method invention. The method may be automatically performed as well when the cruise control system is increasing power to resume to a set speed.

The method is similar to the usual method in that it starts with the vehicle 138 at rest and the lever 142 in neutral with the engine 10 operating and movement of the vehicle 138 occurs by moving the accelerator pedal 136 away from its initial position toward its maximum position to progressively increase the power delivered by the engine and hence the speed of movement of the vehicle proportional to how far the pedal is moved away from the initial position.

The method differs from the usual because the engine has four different pairs of piston and cylinder assemblies capable of operating in five different power level steps based on four changes in the number of injections and the injection option of dual firing (mode 1) or single injection shared power (mode 2).

The method involves transmitting signals from the pedal position sensor 134 through lines 132 to the computer 128 which are indicative of the position the pedal is in. The computer processes the position signals and determines a zone of pedal positions the pedal is in including a low power zone of positions between the initial position and a first transition position, a first intermediate power zone of positions between the first transition position and a second transition position, a second intermediate power zone of positions between the second transition position and a third transition position, a third intermediate power zone of positions between the third transition position and a fourth transition position, and a high power zone of positions between the fourth transition position and the maximum position.

As a result of determining the power zone the pedal 136 is in, a zone signal indicative of the zone determined is transmitted to the injectors 48 of the four pairs of assemblies. The injectors 48 receive the zone signals as corresponding step signals so that the four pairs of assemblies operate in the desired power level step for the corresponding power zone determined. That is, a zone signal for a given power mode represents the collective signals sent to individual fuel injectors.

The major distinguishing characteristic as between the power level steps is that a different number of injections occur in each. The number is dependent on the injection option of either two injections per pair as in the dual firing mode (mode 1) or one injection per pair as in the single injection shared power mode (mode 2). Since (mode 2) involves the injection of the lesser amount of fuel, when all four pairs of assemblies are operating in (mode 2) there is the least amount of fuel injected. This step of operation is designated as a low power level step equivalent to the low power zone of the pedal positions. In the low power level step, one of each of the four pairs is skipped an injection and the drive event of each of the four pairs of assemblies is a pair of shared power drive events. Consequently, there is a ½ (50%) fuel savings but a greater than the expected 50% of power available due to the sharing (an estimated 70%).

The next step up is the first intermediate power level step equivalent to the first intermediate power zone of pedal positions. In this step, three pairs of assemblies are operating in (mode 2) and one pair in (mode 1) so that there is only three skipped injections and a total of 5 out of 8 injections which take place. Consequently, with this additional injection, the fuel saving goes from ⅝ to ⅜ (37.5%) and the power available rather than going from the expected 50% to 62.5% is at an estimated 77.5% because three pairs still have shared power drive events.

The next step up is the second intermediate power level step equivalent to the second intermediate zone of pedal positions. In this step, two pairs of assemblies operate in (mode 2) and two pairs operate in (mode 1) so that there are two skipped injections and a total of 6 out of 8 injections that take place. Consequently, with this additional injection, the fuel saving goes from ⅜ to ⅝ (25%) and the power available rather than going from an expected 62.5% to 75% is at an estimated 85%.

The next step up is third intermediate power level step equivalent to the third intermediate power zone of pedal positions in this zone. In this step, one pair of assemblies is in (mode 2) and three pairs are in (mode 1) so that there is one skipped injection and a total of 7 out of 8 injections that take place. Consequently, with this additional injection, the fuel saving goes from ⅝ to ⅛ (12.5%) and the power available rather than going from an expected 75% to 86.5% is an estimated 95⅞%.

The next and last step up is the high power level step equivalent to the high power zone of pedal positions. In this step, all four pairs are in (mode 1) with no skipped injections and 8 out of 8 injections taking place with no fuel savings and 100% of power available.

In order to smooth the transition between the power level steps, the position signals are also processed by the computer 128 to determine the amount of fuel injected per injection as between minimum and maximum so that the total amount of fuel injected progressively increases or decreases as the accelerator pedal is moved in corresponding opposite directions between the initial and maximum positions.

When the four pairs of assemblies are in the low power level step, the amount of fuel injected is at a minimum and increases progressively to the end of the step to a first maximum where the pedal is at the first transition position which also is the position for the start of the next step which has an added injection. In order to have a smooth transition between the two steps, the total amount of fuel injected at the end of the preceding step is made to be equal to the total amount of fuel at the beginning of the following step. At the end of the low power level step, all four pairs of assemblies are at the first maximum level so that at the start of the next step any pair of assemblies staying in (mode 2) remains at the first maximum and any pair changing to (mode 1) is reduced an amount equal to one injection at the first maximum amount. As the step progresses to its end, the amount of fuel injected increases until at the end with the pedal in the second transition position the amount is at a second maximum amount. The same procedure of starting with an equal total amount by reducing the pairs operating in (mode 1) and increasing to a maximum for that step is continued at the third and fourth transition positions with third and fourth maximums at the ends.

Preferably, there is provided a sensor (not shown) which is capable of sensing a condition determinative of the load being carried by the vehicle. For example, a load cell between a semi rig cab and trailer measuring pull force, a scale sensor for measuring added load, or an acceleration sensor for a determined condition. The signal indicative of the load carried when transmitted to the computer is processed by the computer to modify the transition positions and/or the maximum amounts of fuel injected at the end of each step.

For example, when a no load signal is received, the computer determines the first transition position to be moved to a new position away from the initial position and the others proportionally, and/or the first maximum amount of fuel injected is determined to be ⅛ of maximum and the other maximums stay at ⅛ of maximum so that the only change at each transition is to reduce the assembly changing from one injection to two injections to ½ of ⅛ of maximum for each of the two.

When a max load signal is received, the computer determines the fourth transition position to be moved to a new position away from the max position and the others proportionally and/or the first maximum amount of fuel injected is determined to be actual maximum and the other maximums stay at actual maximum so that the only change at each transition position is to reduce the assembly changing from one injection to two injections to ½ of actual maximum for each of the two.

There are apparent progressive changes between the two extremes commensurate with load signals indicative of loads between no load and max load.

The foregoing embodiments have been provided solely to illustrate the structural and functional principle of the present invention and are not intended to be limiting. To the contrary, the present invention encompasses all modifications, alternations, substitutions and equivalents within the spirit and scope of the following claims.

The invention claimed is:

1. An internal combustion engine comprising:

a frame assembly having eight crankshaft connected piston and cylinder assemblies therein, said frame assembly including (1) a lower pan component, (2) a central block component and (3) an upper head component, said pan component having two transversely spaced series of longitudinally spaced upwardly facing concave upper surfaces, said central block component being fixedly supported on said pan component and having two corresponding transversely spaced series of longitudinally spaced downwardly facing concave lower surfaces, said eight crankshaft connected piston and cylinder assemblies including (1) two transversely spaced drivingly interconnected crankshafts bearingly supported between the upper and lower surfaces of said pan and central block components, respectively, (2) eight cylinders in said central block component in two banks, each bank containing four cylinders disposed with the longitudinal axes thereof in a common bank plane and with the common bank planes converging equally angularly upwardly on opposite sides of a bisecting vertical plane, (3) eight pistons slidably mounted in said eight cylinders, (4) eight connecting rods pivotally mounted at one end to the eight pistons, and (5) eight computer controlled fuel injectors;

the connecting rods connected to the pistons in the cylinders of each bank of assemblies being connected to a different one of the two crankshafts so as to establish four pairs of assemblies in which the pistons of each pair are moved simultaneously through successive cycles each including simultaneous compression strokes followed immediately by simultaneous power drive strokes, said cylinders being mounted in said central block component so that open upper ends thereof are disposed within upwardly facing upper planar surfaces of said central block component, said head component including downwardly facing lower planar surfaces and being fixedly supported on said central block component with portions thereof covering the open upper ends of said cylinders and with the lower planar surfaces thereof in sealing engagement with the upper planar surfaces of said central block component, one of said head and central block components having four spaced recesses formed therein in communicating relation to the associated planar surfaces disposed in positions transversely between the four pairs of cylinder open ends, an insert of heat-resistant material fixedly mounted in each recess and having a passage extending therethrough having spaced open ends communicating respectively to the open upper ends of the associated pair of cylinders, the fuel injectors being computer controlled so that each pair of assemblies can be selectively operated either in a mode (1) wherein both cylinders of the pair receive a charge of fuel and the associated pistons undergo simultaneous directly fired power drive strokes or in a mode (2) wherein only one cylinder of the pair receives a charge of fuel and the other cylinder is skipped of fuel charge and the associated piston of the charge receiving cylinder undergoes a directly fired power drive stroke while the other piston undergoes a shared power drive stroke by virtue of the communicating passage between the pair of cylinders.

2. The engine as defined in claim 1 wherein the upwardly facing surfaces of said block component and the downwardly facing surfaces of said head component each include first and second angularly related planar surfaces, said first planar surfaces being disposed in perpendicular relation to a first plane passing through the longitudinal axes of the four cylinders in a first of said two banks, said second planar surfaces being disposed in perpendicular relation to a second plane passing through the longitudinal axes of the four cylinders in a second of said two banks.

3. The engine as defined in claim 2 wherein the first planar surfaces of said head and block components are sealingly engaged by a first gasket disposed therebetween and the second planar surfaces of said head and block components are sealingly engaged by a second gasket disposed therebetween.

4. The engine as defined in claim 2 wherein each of said recesses is formed in said head component.

5. The engine as defined in claim 4 wherein each of said recesses is defined between end walls by right angular U-shaped walls opening downwardly.

6. The engine as defined in claim 5 wherein the passage in each insert is configured to include spaced end portions each extending longitudinally upwardly from an open end of a cylinder with a diminishing cross sectional area and a central portion extending transversely between said end portions.

7. The engine as defined in claim 6 wherein each insert is divided into two abutting pieces along the axis of said central portion so that the internal surfaces defining the passage are polished while the pieces are separated.

8. The engine as defined in claim 7 wherein each of said inserts is made of inconel as the heat resistant material thereof.

9. The engine as defined in claim 4 wherein said head component covering the open ends of said cylinder comprises for each cylinder a head portion having a downwardly facing planar surface disposed perpendicularly to the axis of the associated cylinder, each head portion having transversely spaced inlet and outlet openings extending downwardly therethrough and terminating in downwardly facing frustoconical valve seats, said head component having inlet and outlet poppet valves spring biased to move into closing relation to said inlet and outlet valve seats and a rotatably mounted cam shaft device for moving said inlet and outlet poppet valves against the spring bias thereof into opening relation to said inlet and outlet valve seats in cyclically timed relation.

10. The engine as defined in claim 9 wherein there are two longitudinally spaced inlet openings in transversely spaced relation with respect to one outlet opening.

11. The engine as defined in claim 10 wherein the cam shaft device includes a cam shaft for each bank, each having inlet and outlet cams thereon for moving the associated inlet and outlet poppet valves in cyclically timed relation during each revolution of the associated cam shaft.

12. The engine as defined in claim 11 wherein said cam shaft device includes a cam follower for each poppet valve connected to be moved by an associated cam of the associated cam shaft and to move the associated poppet valve when moved by the associated cam.

13. The engine as defined in claim 12 wherein each cam follower is in the form of a transversely extending lever having one end connected to the associated poppet valve, an opposite end pivoted to the head component and a roller on a midportion thereof disposed in motion transmitting relation with respect to an associated cam.

14. The engine as defined in claim 13 wherein the lever associated with said two inlet openings in each assembly is U-shaped with spaced legs on the valve connected end thereof and the associated injector extends between said legs so that a discharge end thereof injects a charge of fuel in response to computer commands to do so downwardly into the center of the open end of the associated cylinder so as to mix with air under auto ignition pressure and temperature contained within a recess in the upper surface of the associated piston.

15. The engine as defined in claim 1 wherein a mixture of air and fuel is establish in the combustion chamber of each assembly by injecting fuel and air into the associated cylinder during an intake stroke preceding the compression stroke and the mixture is ignited by the energization of a spark plug in communication with the mixture.

16. An internal combustion engine comprising:

a frame assembly, eight piston and cylinder assemblies mounted in said frame assembly in two banks of four inline assemblies, the two banks being associated with two spaced interconnected crankshafts, each operatively connected to the four assemblies of one row so that the two rows extend upwardly in converging angular relation to one another on opposite sides of a bisecting plane, each piston and cylinder assembly including (1) a cylinder with a combustion chamber, (2) a crankshaft connected piston moveable within the cylinder toward and away from the combustion chamber in repetitive strokes, in a number of which a repetitive cycle is completed, each cycle including an intake event, a compression event, a drive event and an exhaust event, and (3) a fuel injector positioned to inject fuel into the cylinder, the eight assemblies have their pistons crankshaft connected so that the pistons of two outer assemblies of both rows and two inner assemblies of both rows move together in simultaneous strokes in opposite directions thereby providing four pairs of simultaneously moving assemblies in which one assembly of each pair is in one bank and the other assembly of each pair is opposite thereto in the other bank, the cylinders of each of said four pairs of assemblies being intercommunicated by a passage extending transversely between their associated combustion chambers, the injectors of each of said four pairs of assemblies being computer controlled during each cycle to selectively operate either (1) in a mode 1 wherein both cylinders of the pair receive an injection resulting in a pair of directly fired power drive events during that cycle or (2) in a mode 2 wherein one of the cylinders of the pair is skipped an injection while the other cylinder receives an injection resulting in a pair of shared power drive events during that cycle, the sharing being the result of the high pressure conditions created in the directly fired power drive event occurring in the cylinder which received the injection being communicated through the associated passage to the cylinder which was skipped.

17. A method of operating the engine as defined in claim 16 to move a vehicle in having an accelerator pedal moveable between an idle position and a maximum position in a direction away from an initial position to progressively pass through first, second, third, and fourth transition positions each further away from the initial position and in an opposite direction away from the maximum position to progressively pass through said four transition positions in reverse, the method comprising operating the engine so that four paired drive events occur during four consecutive simultaneous piston drive strokes, and making successive selected pedal movements between the initial position and the maximum position to move the vehicle at a desired speed by correspondingly changing the power delivered by the engine based on the selected pedal movement so that when the selected pedal movement is (1) through progressive pedal positions between the initial position and the first transition position each of the four paired drive events is a pair of shared power drive events, and the total amount of fuel injected progressively increases from an amount less than maximum at the initial position to a maximum amount for the number of injections made at the first transition position, (2) through progressive pedal positions between the first transition position and the second transition position, the four paired drive events include three pairs of shared power drive events and one pair of directly fired power drive events, and the total amount of fuel injected progressively increases from the total amount injected at the first transition position to a maximum amount for the added number of injections, (3) through progressive positions between the second transition position and the third transition position, the four paired drive events include two pairs of shared power drive events and two pairs of directly fired power drive events and the total amount of fuel injected progressively increases from an amount equal to the amount injected at the second transition position to a maximum amount at the third transition position for the added number of injections, (4) through progressive positions between the third transition position and the fourth transition position the four paired drive events include one pair of shared power drive events and three pairs of directly fired power and the total amount of fuel injected progressively increases from an amount equal to the amount injected at the third transition position to a maximum amount at the fourth transition position for the added number of injections, and (5) through progressive positions between the fourth transition and the maximum position the four paired drive events include four pairs of directly fired power drive events and the total amount of fuel injected progressively increases from an amount equal to the amount injected at the fourth transition position to a maximum amount for the added number of injections.

18. A method as defined in claim 17 wherein the maximums at the end of each step are changed in response to the sensing condition determinative of load carried by the vehicle of a predetermined amount.

19. A method as defined in claim 18 wherein the transition positions are changed in response to the sensing a condition determinative of a load carried by the vehicle of a predetermined amount.

20. A method as defined in claim 18 wherein the vehicle includes a manually actuated cruise control system capable when actuated at a set speed to automatically move the accelerator pedal to obtain the set speed, sending a cruise control activation signal to the computer when the cruise control system is manually actuated, sending only cruise control output signals from the computer to the injectors after the activation signal is received until a deactivation signal is received in response to the manual deactivation of the cruise control system, the cruise control signals of the computer selectively enabling the injectors of all four assemblies to remain in (mode 2) with the amount of fuel injected from minimum to maximum being determined by the position the accelerator pedal is moved between idle and max respectively automatically by the cruise control system.

* * * * *